US005415982A

United States Patent [19]

Deguchi

[11] Patent Number: 5,415,982

[45] Date of Patent: May 16, 1995

[54] METHOD FOR FORMING A COLOR IMAGE

[75] Inventor: Yasuaki Deguchi, Minami Ashigara, Japan

[73] Assignee: Fuji Photo Film Co., Ltd., Kanagawa, Japan

[21] Appl. No.: 68,350

[22] Filed: May 28, 1993

[30] Foreign Application Priority Data

May 29, 1992 [JP] Japan ..... 4-139348

[51] Int. Cl.[6] ..... G03C 7/407

[52] U.S. Cl. ..... 430/385; 430/384; 430/546; 430/631; 430/637

[58] Field of Search ..... 430/384, 385, 546, 631, 430/637, 963

[56] References Cited

U.S. PATENT DOCUMENTS

| | | | |
|---|---|---|---|
| 4,239,851 | 12/1980 | Aoki et al. | 430/546 |
| 5,091,297 | 6/1990 | Fukunaga et al. | 430/558 |
| 5,200,307 | 4/1993 | Takahashi | 430/546 |
| 5,244,776 | 9/1993 | Kawai | 430/963 |

FOREIGN PATENT DOCUMENTS 0448248 11/1991 European Pat. Off. .

*Primary Examiner*—Hoa Van Le

*Attorney, Agent, or Firm*—Birch, Stewart, Kolasch & Birch

[57] ABSTRACT

A color image-forming method wherein a cyan dye image having an excellent hue and less fading due to light and humidity can be obtained and the discharge amount of a processing solution can be reduced is disclosed, which comprises subjecting a silver halide color photographic light-sensitive material comprising a support, having provided thereon a light-sensitive silver halide emulsion layer containing a yellow dye-forming coupler, a light-sensitive silver halide emulsion layer containing a magenta dye-forming coupler, a light-sensitive silver halide emulsion layer containing a cyan dye-forming coupler, and a non-light-sensitive hydrophilic colloid layer, to an exposure and then to a color development with a color developing solution, wherein the above silver halide color photographic light-sensitive material contains at least one scarcely water soluble epoxy compound having at least one group represented by Formula (AO) in at least one layer of the silver halide emulsion layers and non-light-sensitive hydrophilic colloid layer and at least one pyrroloazole type cyan coupler represented by Formula (Ia) in the above silver halide emulsion layer containing the cyan dye-forming coupler; and the light-sensitive material is processed so that a replenishing amount of the color developing solution becomes 20 ml or more and 120 ml or less per $m^2$ of the light-sensitive material.

14 Claims, No Drawings

METHOD FOR FORMING A COLOR IMAGE

FIELD OF THE INVENTION

The present invention relates to a method for forming a color image with a color light-sensitive material containing a light-sensitive silver halide emulsion and a coupler. More specifically, it relates to a method for forming a color image, which can provide a color print capable of providing an image having an improved fastness to light and heat.

BACKGROUND OF THE INVENTION

In general, in a silver halide color photographic light-sensitive material used for a color negative and/or a color print, the light-sensitive layers thereof contain three kinds of silver halide emulsions sensitized so that they have sensitivities to a blue color, a green color and a red color, and the layers are coated on a support in a multilayer constitution. With such materials dyes having different hues according to the light sensitivities of the respective light-sensitive layers, for example, yellow, magenta and cyan dyes, are formed, whereby a color image can be reproduced by a subtractive color method.

Phenol series and naphthol series coupler are known as couplers which can be used in a silver halide color photographic light-sensitive material for a color print. However, several problems are involved in the storing performance of a cyan dye image obtained by using these couplers. For example, there used to be involved the problem that dyes obtained from 2-acylaminophenol cyan couplers described in U.S. Pat. No. 2,367,531 generally had an inferior heat fastness and that dyes obtained from 2,5-diacylaminophenol cyan couplers described in U.S. Pat. No. 2,895,826 generally had an inferior light fastness. Further, dyes obtained from the couplers described in U.S. Pat. Nos. 3,446,622 and 4,333,999 generally have an inferior light fastness and the 1-hydroxy-2-naphthoamide cyan couplers described therein are generally insufficient in terms of both light and heat fastnesses.

Meanwhile, the development of the novel couplers, against these prior couplers, had been promoted for the purpose of obtaining a color photographic light-sensitive material that provided excellent color reproduction and color development and a superior image storing performance. There can be enumerated, for example, the 3-hydroxypyridine series compounds described in European Patent Publication 333,185, 3H-2-dicyanomethylidene-thiazoles described in European Patent Publication 362,808, 3-dicyanomethylidene-2,3-dihydrobenzothiophene-1,1-dioxides described in JP-A-64-32260 (the term "JP-A" as used herein means an unexamined published Japanese patent application), pyrazoloazoles described in JP-A-63-264753 and U.S. Pat. No. 4,873,183, imidazoles described in U.S. Pat. Nos. 4,818,672 and 4,921,783 and JP-A-3-48243, pyralzolopyrimidones and pyrazoloquinazolones described in European Patent Publications 304,001 and 329,036 and JP-A-2-85851, and condensed triazoles described in European Patent Publication 342,637.

These couplers can be used in a color reproduction by improving a hue. However, it is difficult in many cases to obtain both a satisfactory dye image fastness and a coupling reaction activity, at the same time.

Against these problems in the cyan dye image, there are disclosed methods in which cyclic ether compounds or the epoxy group-containing compounds are used to improve a dye image-storing performance, for example, in JP-B-58-45017 (the term "JP-B" as used herein means an examined Japanese patent publication), JP-A-62-75447, JP-A-62-129853, JP-A-62-172353, JP-A-62-198859, JP-A-62-196657, JP-A-64-21447, JP-A-64-23255, JP-A-3-192374, and JP-A-3-223755. However, the investigation performed to improve the fastness of the cyan dye image with these compounds has resulted in finding several problems. For example, while these compounds have the improved effects to light and heat fastness in a phenol series or naphthol series coupler, it has become apparent that the effects thereof sometimes are reduced by half according to the condition of a processing solution in which the light-sensitive material containing these compounds is subjected to a color development.

In recent years, rapidity and low replenishing have strongly been required in the development processing of silver halide light-sensitive materials. Particularly in fields in which it is required to finish a lot of prints for a short period as in the development processing of a light-sensitive material for a color print, a simplification and the rapidity in a processing have been promoted. In recent years, particularly requirements for the protection of the environment have led to requirements for a reduction in the amount of processing waste, that is, a low replenishing.

Where a continuous processing is carried out with a processing solution having a reduced replenishing amount of a developing solution, it has become apparent that the dye image fastness-improving effect of the epoxy compound described above is deteriorated and therefore the development of techniques with which a print having an excellent dye image fastness can be provided has become an important object.

SUMMARY OF THE INVENTION

As apparent from what we have already described, the object of the present invention is to provide a color image-forming method by which a color photo having an improved fastness of a cyan dye image can be obtained. More specifically, it relates to a color image-forming method by which a cyan dye image having an excellent hue can be obtained and with which a rapid processing is possible and with which a color print having less fading due to light and humidity can be obtained even by a low replenishing type processing (wherein the discharge amount of a processing solution can be cut down and an adverse effect to an environment can be reduced).

Intensive investigations made by the present inventors have resulted in their finding that an image having an excellent image storing performance and a superior hue with a high density can be obtained by using pyrroloazole type cyan coupler having the specific substituents described below and a specific scarcely water soluble epoxy compound. Meanwhile, with conventional cyan couplers there used to be involved the problem that a reduction of a replenishing amount in a rapid processing led to the marked deterioration of the image-storing performance achieved by the above scarcely water soluble epoxy compound. However, it has been found that this problem, can surprisingly be solved by using the cyan coupler of the present invention and the above epoxy compound in combination.

Accordingly, the present invention relates to a method for forming a color image, comprising subjecting a silver halide color photographic light-sensitive material comprising a support, having provided thereon a light-sensitive silver halide emulsion layer containing a yellow dye-forming coupler, a light-sensitive silver halide emulsion layer containing a magenta dye-forming coupler, a light-sensitive silver halide emulsion layer containing a cyan dye-forming coupler, and a non-light-sensitive hydrophic colloid layer, to an exposure and then to a color development with a color developing solution; wherein the silver halide color photographic light-sensitive material contains at least one scarcely water soluble epoxy compound having at least one group represented by the following Formula (AO) in at least one layer of the silver halide emulsion layers and non-light-sensitive hydrophilic colloid layer and at least one of the pyrroloazole type cyan couplers represented by the following Formula (Ia) in the above silver halide emulsion layer containing the cyan dye-forming coupler; wherein the light-sensitive material is processed so that a replenishing amount of the color developing solution becomes 20 ml or more and 120 ml or less per $m^2$ of the light-sensitive material;

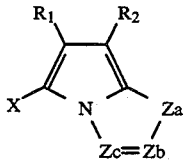

Formula (Ia)

wherein Za represents —NH— or —CH($R_3$)—, and Zb and Zc each represent —C($R_4$)= or —N=; $R_1$, $R_2$ and $R_3$ each represent an electron attractive group having a Hammett's substituent constant $\sigma_p$ of 0.20 or more, provided that the sum of the $\sigma_p$ values of $R_1$ and $R_2$ is 0.65 or more; $R_4$ represents a hydrogen atom or a substituent, provided that when two $R_4$'s are present in the formula, they may be the same or different; X represents a hydrogen atom or a group capable of splitting off upon a reaction with an oxidation product of an aromatic primary amine color developing agent; the group represented by $R_1$, $R_2$,$R_3$, $R_4$ or X may become a divalent group and combine to form a dimer or higher polymer, or bond to a high molecular chain to form a homopolymer or a copolymer;

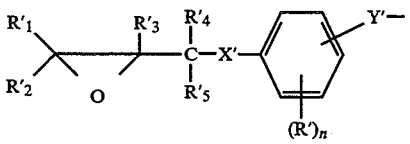

Formula (AO)

wherein $R'_1$, $R'_2$, $R'_3$, $R'_4$ and $R'_5$ may be the same or different and each represent a hydrogen atom, an alkyl group or an aryl group; R' represents a substituent and n represents an integer of 0 to 4; —Y'— represents a divalent linkage group; —X'— represents —O—, —S— or —N(R'')—; R'' represents a hydrogen atom, an acyl group, an alkylsulfonyl group, an arylsulfonyl group, an aryl group, a heterocyclic group, or —C($R'_6$)($R'_7$)($R'_8$), in which $R'_6$, $R'_7$ and $R'_8$ may be the same or different and each represent an alkyl group or a group represented by the following Formula (AO-1); and alternatively $R'_6$ and $R'_7$ can each represent a hydrogen atom;

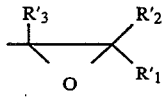

Formula (AO-1)

when n is 2, 3 or 4, plural R's may be the same as or different from each other; any two of $R'_1$ to $R'_5$, R'' and R' or two R's may combine with each other to form a 5- to 7-membered ring; when X' is —S—, the sum number of carbon atoms in number of the compound is preferably 15 or more; when X' is —O— and —Y'— is —$SO_2$— or a phenylene group, n is preferably the integer of 1 to 4 or at least one of $R'_1$, $R'_2$, $R'_3$, $R'_4$ and $R'_5$ is preferably an alkyl group or an aryl group; and when X' is —O— and Y' is —O—$CO_2$—, the sum number of carbon atoms of $R'_1$ to $R'_5$ and R' is preferably 10 or more.

DETAILED DESCRIPTION OF THE INVENTION

The compounds of the present invention will be described below in detail.

To be concrete, the pyrroloazole type cyan dye-forming couplers of the present invention represented by Formula (Ia) are also represented by Formulas (IIa) to (VIIIa):

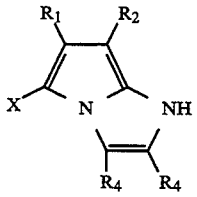

(IIa)

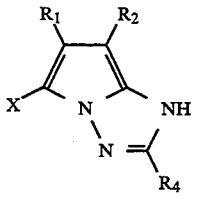

(IIIa)

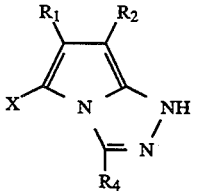

(IVa)

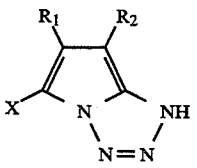

(Va)

-continued

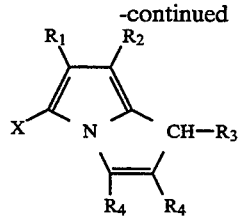
(VIa)

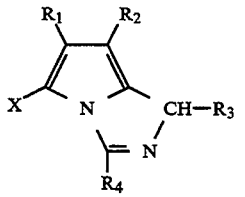
(VIIa)

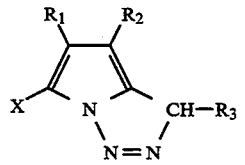
(VIIIa)

In Formulas (IIa) to (VIIIa), $R_1$, $R_2$, $R_3$, $R_4$ and X are synonymous with $R_1$, $R_2$, $R_3$, $R_4$ or X in Formula (Ia).

In the present invention, a cyan coupler represented by Formula (IIa), (IIIa) or (IVa) is preferred and a cyan coupler represented by Formula (IIIa) is particularly preferred.

In a cyan coupler of the present invention, $R_1$, $R_2$ and $R_3$ each are electron attractive groups having the Hammett's substituent constant $\sigma_p$ value of 0.20 or more, and wherein the total of the $\sigma_p$ values of $R_1$ and $R_2$ is 0.65 or more. The total of the $\sigma_p$ values of $R_1$ and $R_2$ is preferably. 0.70 or more and the upper limit thereof is not much more than 1.8.

$R_1$, $R_2$ and $R_3$ each are electron attractive groups shaving the $\sigma_p$ value of 0.20 or more, preferably 0.35 or more, and more preferably 0.60 or more. The upper limit thereof is 1.0 or less. The Hammett's rule is the rule of thumb which was proposed by L. P. Hammett in 1935 in order to quantitatively discuss the affects exerted to a reaction or equilibrium of a benzene derivative by a substituent. In these days, the propriety thereof is widely accepted.

The $\sigma_p$ value and $\sigma_m$ value are available as the substituent constant obtained according to the Hammett's rule and the values thereof are described in many general publications. They are described in, for example, "Lange's Handbook of Chemistry" vol. 12, edited by J. A. Dean, 1979 (McGrew-Hill) and "Chemical Region, Extra Edition" No. 122, pp. 96–103, 1979 (Nankohdo). In the present invention, $R_1$, $R_2$ and $R_3$ are regulated by Hammett's substituent constant $\sigma_p$ value but this does not mean that they are limited to the substituents the $\sigma_p$ values of which are described in these publications. Even if the $\sigma_p$ values of the groups would not be described in the publications, they are naturally included in the scope of the present invention as long as they are included in the above range when they are measured according to Hammett's rule.

There can be enumerated as the concrete examples of $R_1$, $R_2$ and $R_3$ which are the electron attractive groups having the $\sigma_p$ values of 0.20 or more, an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with the other electron attractive group having the $\sigma_p$ value of 0.20 or more, a heterocyclic group, a halogen atom, an azo group, and a selenocyanate group. Of these substituents, the groups capable of further having the substituents may further have the substituents given for the groups defined for $R_4$ described later.

To explain $R_1$, $R_2$ and $R_3$ in more details, there can be enumerated as the electron attractive groups having the $\sigma_p$ values of 0.20 or more, an acyl group (for example, acetyl, 3-phenylpropanoyl, benzoyl, and 4-dodecyloxybenzoyl), an acyloxy group (for example, acetoxy), a carbamoyl group (for example, carbamoyl, N-ethylcarbamoyl, N-phenylcarbamoyl, N,N-dibutylcarbamoyl, N-(2-dodecyloxyethyl)carbamoyl, N-(4-n-pentadecanamido)phenylcarbamoyl, N-methyl-N-dodecylcarbamoyl, and N-[3-(2,4-di-t-amylphenoxy)propyl]carbamoyl), an alkoxycarbonyl group (for example, methoxycarbonyl, ethoxycarbonyl, iso-propyloxycarbonyl, tert-butyloxycarbonyl, iso-butyloxycarbonyl, butyloxycarbonyl, dodecyloxycarbonyl, octadodecyloxycarbonyl, diethylcarbamoylethoxycarbonyl, perfluorohexylethoxycarbonyl, and 2-decylhexyloxycarbonylmethoxycarbonyl), an aryloxycarbonyl group (for example, phenoxycarbonyl and 2,5-di-amylphenoxycarbonyl), a cyano group, a nitro group, a dialkylphosphono group (for example, dimethylphosphono), a diarylphosphono group (for example, diphenylphosphono), a dialkoxyphospholyl group (for example, dimethoxyphospholyl), a diarylphosphinyl group (for example, diphenylphosphinyl), an alkylsulfinyl group (for example, 3-phenoxypropylsulfinyl), an arylsulfinyl group (for example, 3-pentadecylphenylsulfinyl), an alkylsulfonyl group (for example, methanesulfonyl and octanesulfonyl), an arylsulfonyl group (for example, benzenesulfonyl and toluenesulfonyl), a sulfonyloxy group (for example, methanesulfonyloxy and toluenesulfonyloxy), an acylthio group (for example, acetylthio and benzoylthio), a sulfamoyl group (for example, N-ethylsulfamoyl, N,N-dipropylsufamoyl, N-(2-dodecyloxyethyl)sulfamoyl, N-ethyl-N-dodecylsulfamoyl, and N,N-diethylsulfamoyl), a thiocyanate group, a thiocarbonyl group (for example, methylthiocarbonyl and phenylthiocarbonyl), a halogenated alkyl group (for example trifluoromethyl and heptafluoropropyl), a halogenated alkoxy group (for example, trifluoromethyloxy), a halogenated aryloxy group (for example, pentafluorophenyloxy), a halogenated alkylamino group (for example, N,N-di(trifluoromethyl)amino), a halogenated alkylthio group (for example, difluoromethyl and 1,1,2,2-tetrafluoroethylthio), an aryl group substituted with the other electron attractive groups having the $\sigma_p$ value of 0.20 or more (for example, 2,4-dinitrophenyl, 2,4,6-trichlorophenyl, and pentachlorophenyl), a heterocyclic group (for example, 2-benzoxazolyl, 2-benzothiazolyl, 1-phenyl-2-benzimidazolyl, pyrazolyl, 5-chloro-1-tetra-azolyl, and 1-pyrrolyl), a halogen atom (for example, a chlorine atom and a bromine atom), an azo group ( for example, phenylazo), and a selenocyanate group. To enumerate the representative $\sigma_p$ values of the electron attractive groups, they are a cyano group (0.66), a nitro group (0.78), a trifluoromethyl group (0.54), an acetyl group (0.50), a trifluoromethane-sulfonyl group (0.92), a methanesulfonyl group (0.72), a benzenesulfonyl group (0.70), a methanesulfinyl group (0.49), a carbamoyl group (0.36), a methoxycarbonyl group (0.45), a pyrazolyl group (0.37), a methanesulfonyloxy group (0.36), a dimethoxyphospholyl group (0.60), and a sulfamoyl group (0.57).

There can be enumerated as the preferred $R_1$, $R_2$ and $R_3$, an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkoxy group, a halogenated alkylthio group, a halogenated aryloxy group, a halogenated aryl group, an aryl group substituted with two or more nitro groups, and a heterocyclic group. Further preferred are an acyl group, an alkoxycarbonyl group, an aryloxycarbonyl group, a nitro group, a cyano group, an arylsulfonyl group, a carbamoyl group, and a halogenated alkyl group. More preferred are a cyano group, an alkoxycarbonyl group, an aryloxycarbonyl group, and a halogenated alkyl group.

Particularly preferred are a cyano group, a trifluoromethyl group, a straight-chain or branched unsubstituted alkoxycarbonyl group, an alkoxycarbonyl group substituted with a carbamoyl group, an alkoxycarbonyl group having an ether bond, or an aryloxycarbonyl group that is either unsubstituted or substituted with an alkyl group or an alkoxy group.

The combination of $R_1$ and $R_2$ is preferably that $R_1$ is a cyano group and $R_2$ is any of a trifluoromethyl group, a straight-chain or branched unsubstituted alkoxycarbonyl group, an alkoxycarbonyl group substituted with a carbamoyl group, alkoxycarbonyl group having an ether bond, and an aryloxycarbonyl group that is either unsubstituted or substituted with an alkyl group or an alkoxy group.

$R_4$ represents a hydrogen atom or a substituent (including an atom), and there can be enumerated as the substituent, a halogen atom, an aliphatic group, an aryl group, a heterocyclic group, an alkoxy group, an aryloxy group, a heterocyclic oxy group, an alkyl, aryl or heterocyclic thio group, an acyloxy group, a carbamoyloxy group, a silyloxy group, a sulfonyloxy group, an acylamino group, an alkylamino group, an arylamino group, a ureido group, a sulfamoylamino group, an alkenyloxy group, a formyl group, an alkyl, aryl or heterocyclic acyl group, an alkyl, aryl or heterocyclic sulfonyl group, an alkyl, aryl or heterocyclic sulfinyl group, an alkyl, aryl or heterocyclic oxy carbonyl group, an alkyl, aryl or heterocyclic oxy carbonylamino group, a sulfonamide group, a carbamoyl group, a sulfamoyl group, a phosphonyl group, a sulfamide group, an imide group, an azolyl group, a hydroxy group, a cyano group, a carboxy group, a nitro group, a sulfo group, and an unsubstituted amino group. The alkyl group, aryl group or heterocyclic group contained in these groups may further be substituted with the substituents exemplified for $R_4$.

To be more detailed, $R_4$ represents a hydrogen atom, a halogen atom (for example, a chlorine atom and a bromine atom), an aliphatic group (for example, a linear or branched alkyl group having 1 to 36 carbon atoms, an aralkyl group, an alkenyl group, an alkynyl group, a cycloalkyl group, and a cycloalkenyl group, and to be detailed, for example, methyl, ethyl, propyl, isopropyl, t-butyl, tridecyl, 2-methanesulfonylethyl, 3-(3-pentadecylphenoxy)propyl, 3-[4-{2-[4-(4-hydroxyphenylsulfonyl)phenoxy]dodecanamido}phenyl]propyl, 2-ethoxytridecyl, trifluoromethyl, cyclopentyl, and 3-(2,4-di-t-amylphenoxy)propyl), an aryl group (preferably having the carbon atoms of 6 to 36, for example, phenyl, naphthyl, 4-hexadecyloxyphenyl, 4-t-butylphenyl, 2,4-di-t-amylphenyl, 4-tetradecanamidophenyl, and 3-(2,4-di-tert-amylphenoxy-acetoamido)phenyl), a heterocyclic group (for example, 3-pyridyl, 2-furyl, 2-thienyl, 2-pyridyl, 2-pyrimidinyl, and 2-benzothiazolyl), an alkoxy group (for example, methoxy, ethoxy, 2-methoxyethoxy, 2-dodecylethoxy, and 2-methanesulfonylethoxy), an aryloxy group (for example, phenoxy, 2-methylphenoxy, 4-tert-butylphenoxy, 2,4-di-tert-amylphenoxy, 2-chlorophenoxy, 4-cyanophenoxy, 3-nitrophenoxy, 3-t-butyloxycarbamoylphenoxy, and 3-methoxycarbamoylpenoxy), a heterocyclic oxy group (for example, 2-benzimidazolyloxy, 1-phenyltetrazole-5-oxy, and 2-tetahydropyranyloxy) , an alkyl, aryl or heterocyclic thio group (for example, methylthio, ethylthio, octylthio, tetradecylthio, 2-phenoxyethylthio, 3-phenoxypropylthio, 3-(4-tertbutylphenoxy)propylthio, phenylthio, 2-butoxy-5-tertoctylphenylthio, 3-pentadecylphenylthio, 2-carboxyphenylthio, 4-tetradecaneamidephenylthio, 2-benzothiazolylthio, 2,4-diphenoxy-1,3,4-triazole-6-thio, and 2-pyridylthio), an acyloxy group (for example, acetoxy and hexadecanoyloxy), a carbamoyloxy group (for example, N-ethylcarbamoyloxy and N-phenylcarbamoyloxy), a silyloxy group (for example, trimethylsilyloxy and dibutylmethylsilyloxy), a sulfonyloxy group (for example, dodecylsulfonyloxy), an acylamino group (for example, acetoamide, benzamide, tetradecanemide, 2-(2,4-di-tert-amylphenoxy)acetoamide, 2-[4-(4-hydroxyphenylsulfonyl)phenoxy]decaneamide, isopentadecaneamide, 2-(2,4-di-t-amylphenoxy)butaneamide, and 4-(3-t-butyl-4-hydroxyphenoxy)butaneamide), an alkylamino group (for example, methylamino, butylamino, dodecylamino, dimethylamino, diethylamino, and methylbutylamino), an arylamino group (for example, phenylamino, 2-chloroanilino, 2-chloro-5-tetradecaneamidoanilino, N-acetylanilino, 2-chloro-5-[α-2-tert-butyl-4-hydroxyphenoxy)docaneamido]anilino, and 2-chloro-5-dodecyloxycarbonylanilino), a ureido group (for example, methylureido, phenylureido, N,N-dibutylureido, and dimethylureido), a sulfamoylamino group (for example, N,N-dipropylsulfamoylamino and N-methyl-N-decylsulfamoylamino), an alkenyloxy group (for example, 2-propenyloxy), a formyl group, an alkyl, aryl or heterocyclic acyl group (for example, acetyl, benzoyl, 2,4-di-tert-amylphenylacetyl, 3-phenylpropanoyl, and 4-dodecyloxybenzoyl), an alkyl, aryl or heterocyclic sulfonyl group (for example, methanesulfonyl, octanesulfonyl, benzenesulfonyl, and toluenesulfonyl), an alkyl, aryl or heterocyclic sulfinyl group (for example, octanesulfinyl, dodecanesulfinyl, phenylsulfinyl, 3-pentadecylphenylsulfinyl, and 3-phenoxypropylsulfinyl), an alkyl, aryl or heterocyclic oxy carbonyl group (for example, methoxycarbonyl, butoxycarbonyl, dodecyloxycarbonyl, octadecyloxycarbonyl, phenyloxycarbonyl, and 2-pentadecyloxycarbonyl), an alkyl, aryl or heterocyclic oxy carbonylamino group (for example, methoxycarbonylamino, tetradecyloxycarbonylamino, phenoxycarbonylamino, and 2,4-di-tert-butylphenoxycarbonylamino), a sulfon-amide group (for example, methanesulfonamide, hexadecanesulfonamide, benzenesulfonamide, p-toluenesulfonamide, octadecaneuslfonamide, and 2-methoxy-5-tert-butylbenzenesulfonamide), a carbamoyl group (for example, ethylcarbamoyl, N,N-dibutylcarbamoyl, N-(2-dodecyloxyethyl)carbamoyl, N-methyl-N-dodecylcarbamoyl, and N-[3-(2,4-di-tertamylphenoxy)propyl]carbamoyl), a sulfamoyl group (for example, N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a phosphonyl group (for example, phenoxyphosphonyl, octyloxyphosphonyl, and phenylphosphonyl), a sulfamide group (for example, dipropylsulfamoylamino), an imide group (for example, N-succinimide, hydantoinyl, N-phthalimide, and 3-octadecenylsuccinimide), an azolyl group (for example, imidazolyl, pyrazolyl, 3-chloropyrazole-1-yl, and triazolyl), a hydroxy group, a cyano group, a carboxy group, a nitro group, a sulfo group, and an unsubstituted amino group.

There can be preferably enumerated as $R_4$, an alkyl group, an aryl group, a heterocyclic group, a cyano group, a nitro group, an acylamino group, an arylamino group, a ureido group, a sulfamoylamino group, an alkylthio group,an arylthio group, a heterocyclic thio group, an alkoxycarbonylamino group, an aryloxycarbonylamino group, a sulfonamide group, a carbamoyl group, a sulfamoyl group, a sulfonyl group, an alkoxycarbonyl group, an aryloxycarbonyl group, a heterocyclic oxy group, an acyloxy group, a carbamoyloxy group, an imide group, a sulfinyl group, a phosphonyl group, an acyl group, and an azolyl group.

Further preferred are an alkyl group and an aryl group. More preferred is the alkyl group or aryl group having at least one alkoxy group, sulfonyl group, sulfamoyl group, carbamoyl group, acylamide group, or sulfonamide group as a substituent. Particularly preferred is the alkyl group or aryl group having at least one acylamide group or sulfonamide group as a substituent.

In Formula (Ia), X represents a hydrogen atom or the group (hereinafter referred to as a splitting group) which is split off when the coupler reacts with the oxidation product of an organic primary amine color developing agent. When X represents the splitting group, the splitting group is a halogen atom; an aromatic azo group; an alkyl group, aryl group, heterocyclic group, alkyl- or arylsulfonyl group, arylsulfinyl group, alkoxy-, aryloxy- or heterocyclic oxy carbonyl group, aminocarbonyl group, or alkyl-, aryl- or heterocyclic carbonyl group each bonded to a coupling site via an oxygen, nitrogen, sulfur or carbon atom; or a heterocyclic group bonded to the coupling site via a nitrogen atom in the heterocycle. There are given, for example, a halogen atom, an alkoxy group, an aryloxy group, an acyloxy group, an alkyl- or arylsulfonyloxy group, an acylamino group, an alkyl- or arylsulfonamide group, an alkoxycarbonyloxy group, an aryloxycarbonyloxy group, an alkyl-, aryl- or heterocyclic thio group, a carbamoylamino group, an arylsulfinyl group, an arylsulfonyl group, a 5-membered or 6-membered nitrogen-containing heterocyclic group, an imide group, and an arylazo group. The alkyl group, aryl group or heterocyclic group contained in these splitting groups may further be substituted with the substitutents enumerated for $R_4$. When these substituents are two or more, they may be the same or different. These groups may further have the substituents enumerated for $R_4$.

To be more detailed, the splitting group is a halogen atom (for example, a fluorine atom, a chlorine atom and a bromine atom), an alkoxy group (for example, ethoxy, dodecyloxy, methoxyethylcarbamoylmethoxy, carboxypropyloxy, methylsulfonylethoxy, and ethoxycarbonylmethoxy), an aryloxy group (for example, 4-methylphenoxy, 4-chlorophenoxy, 4-methoxyphenoxy, 4-carboxyphenoxy, 3-ethoxycarboxyphenoxy, 3-acetylaminophenoxy, and 2-carboxyphenoxy), an acyloxy group (for example, acetoxy, tetradecanoyloxy, and benzolyoxy), an alkyl- or arylsulfonyloxy group (for example, methanesulfonyloxy and toluenesulfonyloxy), an acylamino group (for example, dicholoracetylamino and heptafluorobutylylamino), an alkyl- or arylsulfonamide group (for example, methanesulfonamide, trifluoromethanesulfonamide, and p-tolunesulfonylamino), an alkoxycarbonyloxy group (for example, ethoxycarbonyloxy and benzyloxycarbonyloxy), an aryloxycarbonyloxy group (for example, phenoxycarbonyloxy), an alkyl-, aryl- or heterocyclic thio group (for example, ethylthio, 2-carboxyethylthio, dodecylthio, 1-carboxydodecylthio, phenylthio, 2-butoxy-5-t-octylphenylthio, and tetrazolylthio), an arylsulfonyl group (for example, 2-butoxy-5-tert-octylphenylsulfonyl), an arylsulfinyl group (for example, 2-butoxy-5-tert-octylphenylsulfinyl), a carbamoylamino group (for example, N-methylcarbamoylamino and N-phenylcarbamoylamino), a 5-membered or 6-membered nitrogen-containing heterocyclic group (for example, imidazolyl, pyrazolyl, triazolyl, tetrazolyl, and, 1,2-dihydro-2-oxo-1-pyridyl), an imide group (for example, succinimide and hydantoinyl), and an arylazo group (for example, phenylazo and 4-methoxyphenylazo). These groups may further be naturally substituted with the substitutents enumerated for $R_4$. There is available as a splitting group bonded via a carbon atom, a bis type coupler which can be obtained by condensing a tetra-equivalent coupler with aldehydes and ketones. The splitting group according to the present invention may contain the photographically useful groups such as a development inhibitor and a development accelerator.

X is preferably a halogen atom, an alkoxy group, an aryloxy group, an alkyl- or arylthio group, an arylsulfonyl group, an arylsulfinyl group, or a 5-membered or 6-membered nitrogen-containing heterocyclic group bonded to a coupling active site via the nitrogen atom. X is more preferably an arylthio group.

In the cyan coupler represented by Formula (Ia), the group represented by $R_1$, $R_2$, $R_3$, $R_4$ or X may contain the cyan coupler residue represented by Formula (Ia) and form a dimer or a polymer higher than a dimer, or the group represented by $R_1$, $R_2$, $R_3$, $R_4$ or X may bond to a high molecular chain to form a homopolymer or a copolymer. The homopolymer or copolymer containing the high molecular chain is an addition polymer having the cyan coupler residue represented by Formula (Ia), and the typical example thereof is a homopolymer or copolymer of an ethylene type unsaturated compound. In this case, one or more kinds of a cyan color development repetitive unit having the cyan coupler residue represented by Formula (Ia) may be contained in the polymer and one or more kinds of a non-color developable ethylene type monomer such as acrylic acid ester, methacrylic acid ester, and maleic acid ester, which is not subjected to a coupling with the oxidation product of an aromatic primary amine developing agent, may be contained in the polymer as a copolymerization component.

The concrete examples of the coupler of the present invention are shown below but the present invention is not limited thereto.

(1)
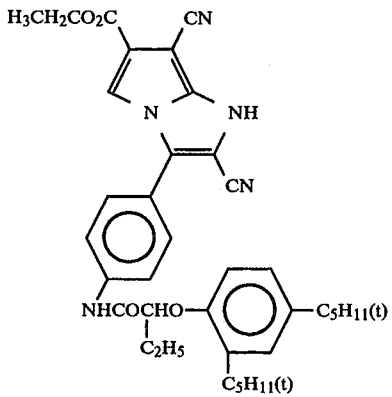
A
(2)
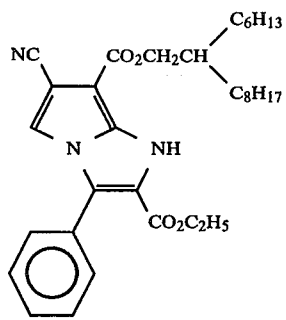
(3)
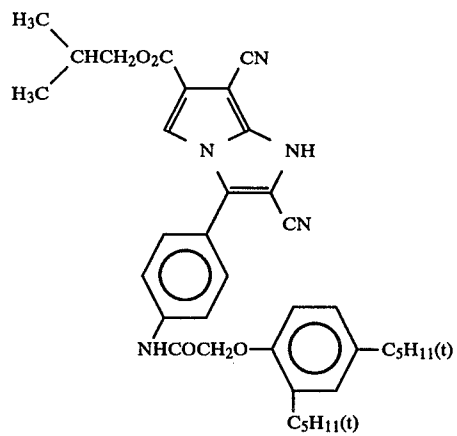

-continued
(4)
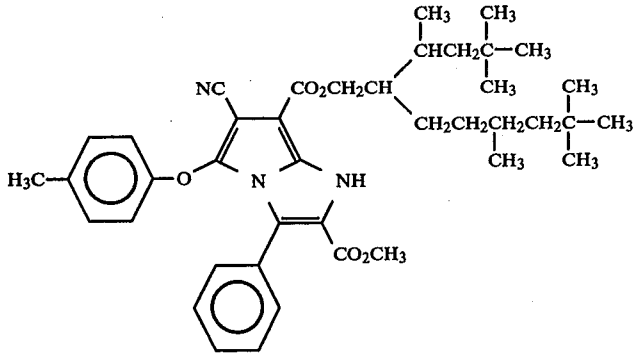
(5)
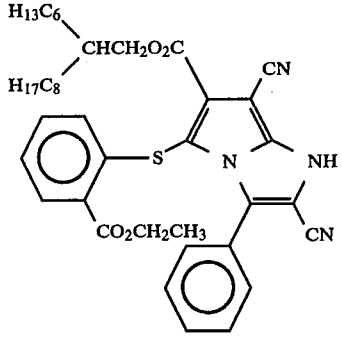
(6)
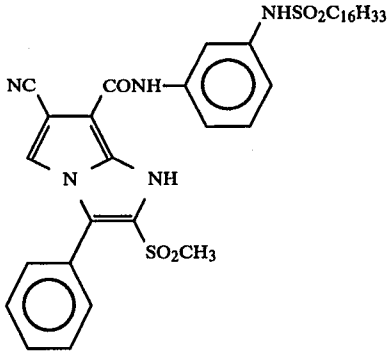
(7)
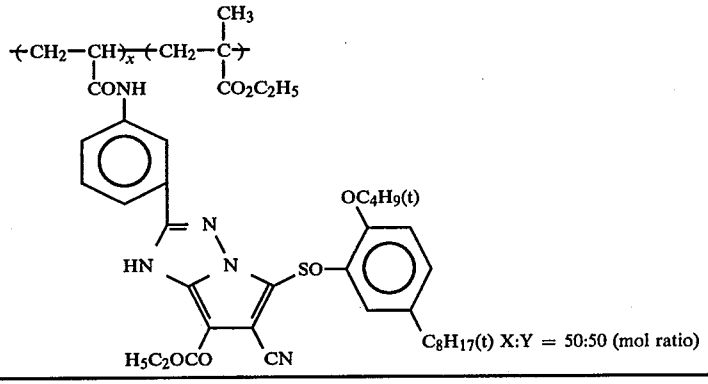
$C_8H_{17}(t)$ X:Y = 50:50 (mol ratio)
| No. | $R_1$ | $R_2$ | $R_4$ | X |
|---|---|---|---|---|
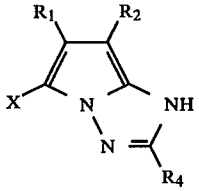

-continued
| | | | | |
|---|---|---|---|---|
| 8 | $CO_2CH_3$ | CN | 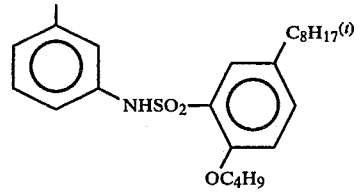 | H |
| 9 | CN | 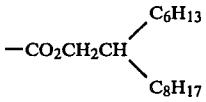 | 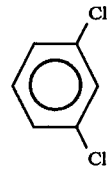 | H |
| 10 | CN | 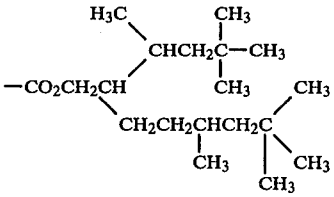 | 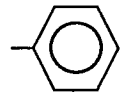 | H |
| 11 | CN | 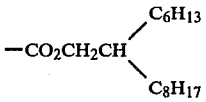 | 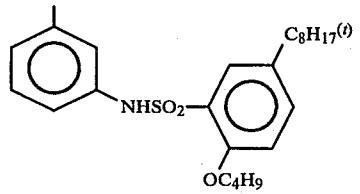 | H |
| 12 | CN | 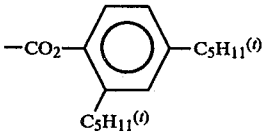 | 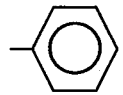 | H |
| 13 | CN | 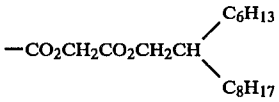 | 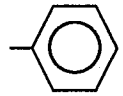 | H |

-continued
| | | | | |
|---|---|---|---|---|
| 14 | CN | $-CO_2CH_2CH_2(CF_2)_6F$ | 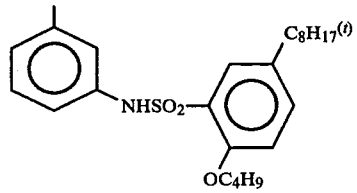 | H |
| 15 | CN | 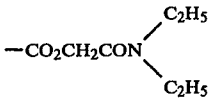 | 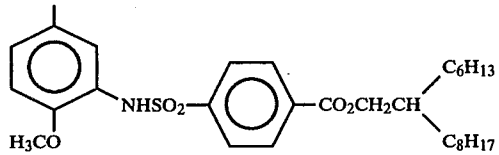 | 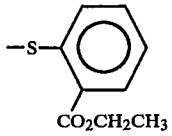 |
| 16 | CN | $-CO_2CH_2CH_2(CF_2)_6F$ | 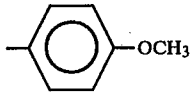 | 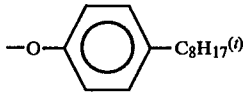 |
| 17 | CN | 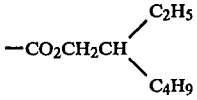 | 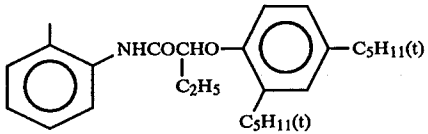 | 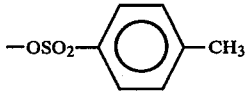 |
| 18 | CN | 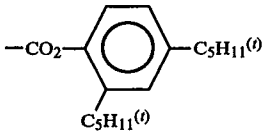 | 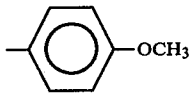 | 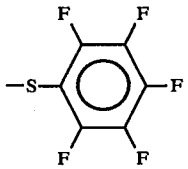 |
| 19 | CN | 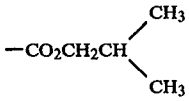 | 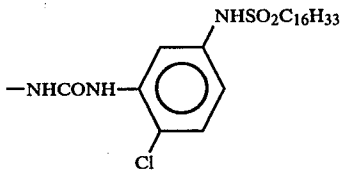 | 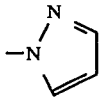 |

-continued
| | | | | |
|---|---|---|---|---|
| 20 | CN | $-CO_2CH_2(CF_2)_4H$ | 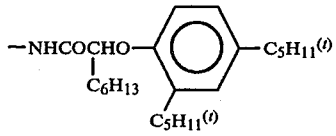 | 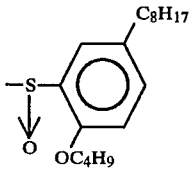 |
| 21 | CN | 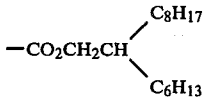 | 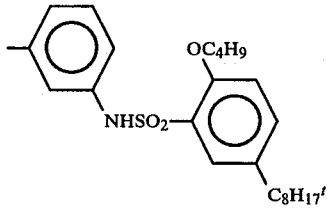 | H |
| 22 | 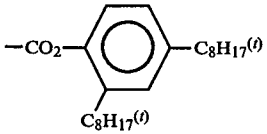 | CN | 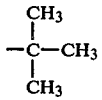 | 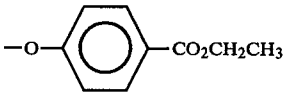 |
| 23 | $-CO_2CH_2C_6F_{13}$ | CN | 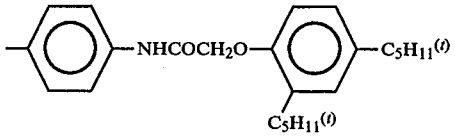 | Cl |
| 24 | 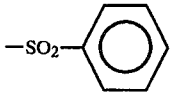 | 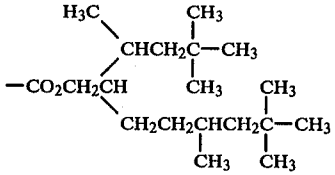 | $CH_3$ | $-OCOCH_3$ |
| 25 | CN | $-CO_2CH_2CO_2CH_3$ | 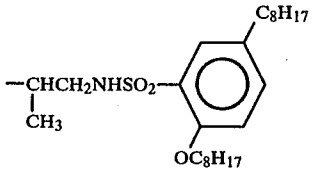 | 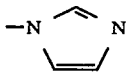 |

-continued
| | | | | |
|---|---|---|---|---|
| 26 | CN | 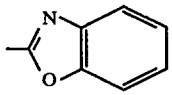 | 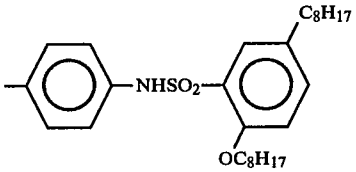 | 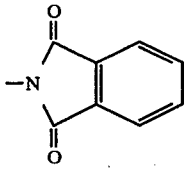 |
| 27 | CN | $CF_3$ | 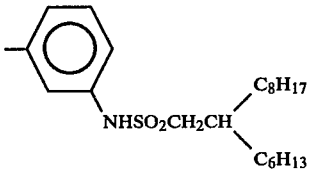 | Cl |
| 28 | 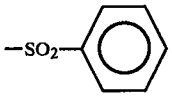 | $CF_3$ | 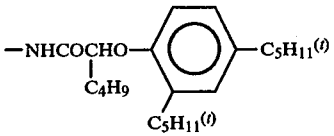 | F |
| 29 | CN | 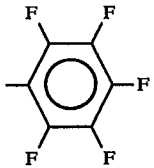 | 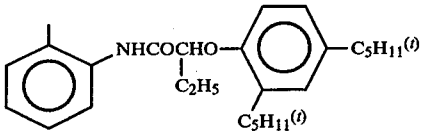 | 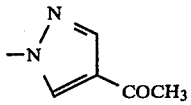 |
| 30 | 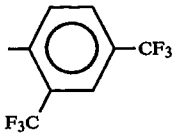 | 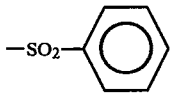 | 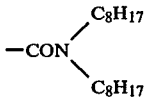 | 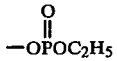 |

-continued
| | | | | |
|---|---|---|---|---|
| 31 | CN | 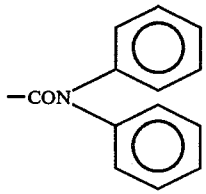 | 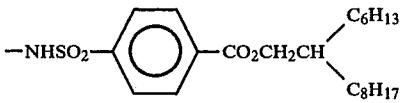 | 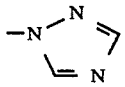 |
| 32 | CN | 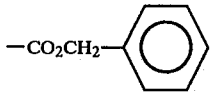 | 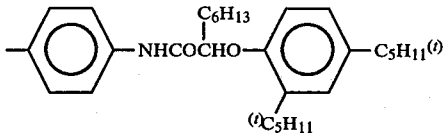 | H |
| 33 | CN | 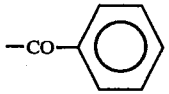 | 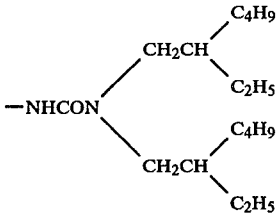 | $-OSO_2CH_3$ |
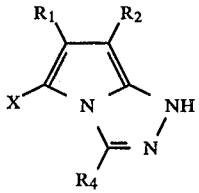
| | | | | |
|---|---|---|---|---|
| 34 | $-CO_2C_2H_5$ | CN | 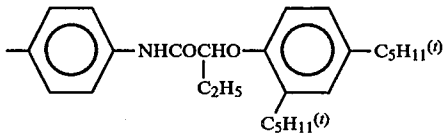 | Cl |

-continued
| | | | | |
|---|---|---|---|---|
| 35 | CN | 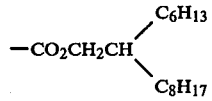 | 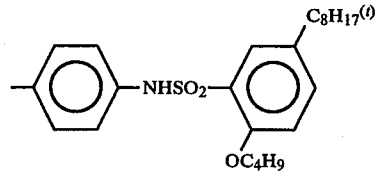 | H |
| 36 | CN | $-CO_2CH_2CH_2(CF_2)_6F$ | 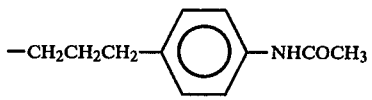 | 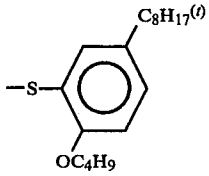 |
| 37 | CN | 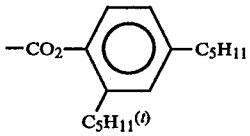 | 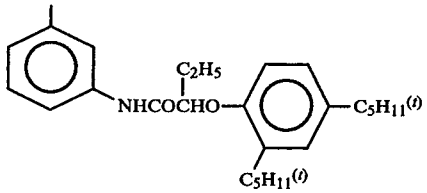 | 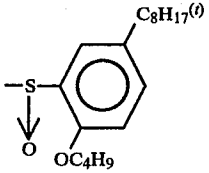 |
| 38 | CN | 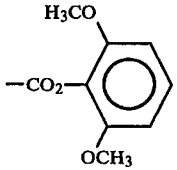 | $-CH_2\underset{\displaystyle CH_3}{\underset{\mid}{C}}HSO_2C_{16}H_{33}(i)$ | 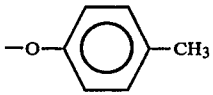 |
| 39 | CN | 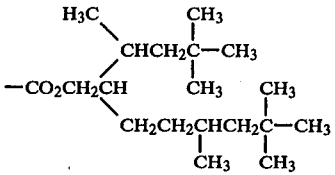 | 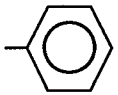 | H |

-continued
| | | | | |
|---|---|---|---|---|
| 40 | CN | $-CO_2CH(CH_3)_2$ | 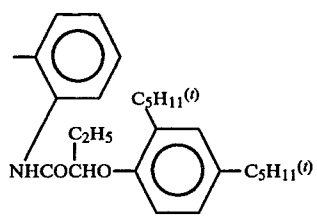 | Cl |
| 41 | CN | $-CON(C_2H_5)_2$ | 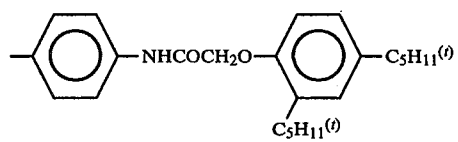 | $-OSO_2CH_3$ |
(42)
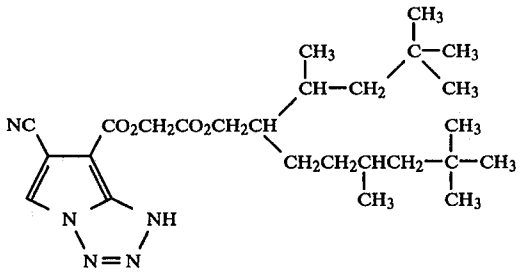
(43)
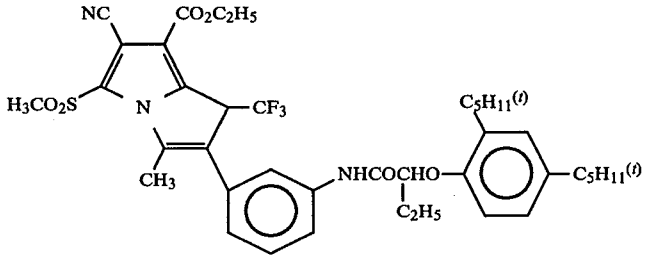
(44)
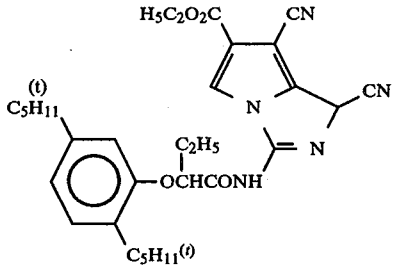
(45)
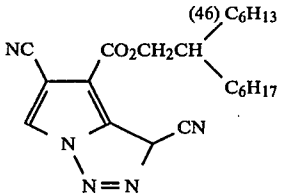
(46)
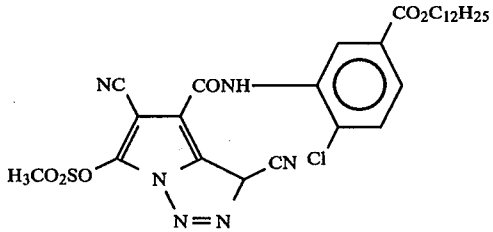

The compounds of then present invention and the intermediate products thereof can be synthesized by publicly known methods. They can be synthesized according to the methods described in, for example, *J. Am. Chem. Soc.*, No. 80, 5332 (1958), *J. Am. Chem. Soc.*, No. 81, 2452 (1959), *J. Am. Chem. Soc.*, No. 112, 2465 (1990), *Org. Synth.*, I, 270 (1941), *J. Chem. Soc.*, 5149 (1962), *Heterocycles*, No. 27, 2301 (1988), and *Rec. Tray. Chim.*, 80, 1075 (1961), the publications cited therein, or the methods equivalent thereto.

Synthetic example 1: synthesis of the exemplified compound (9)

The exemplified compound (9) was synthesized via the following route:

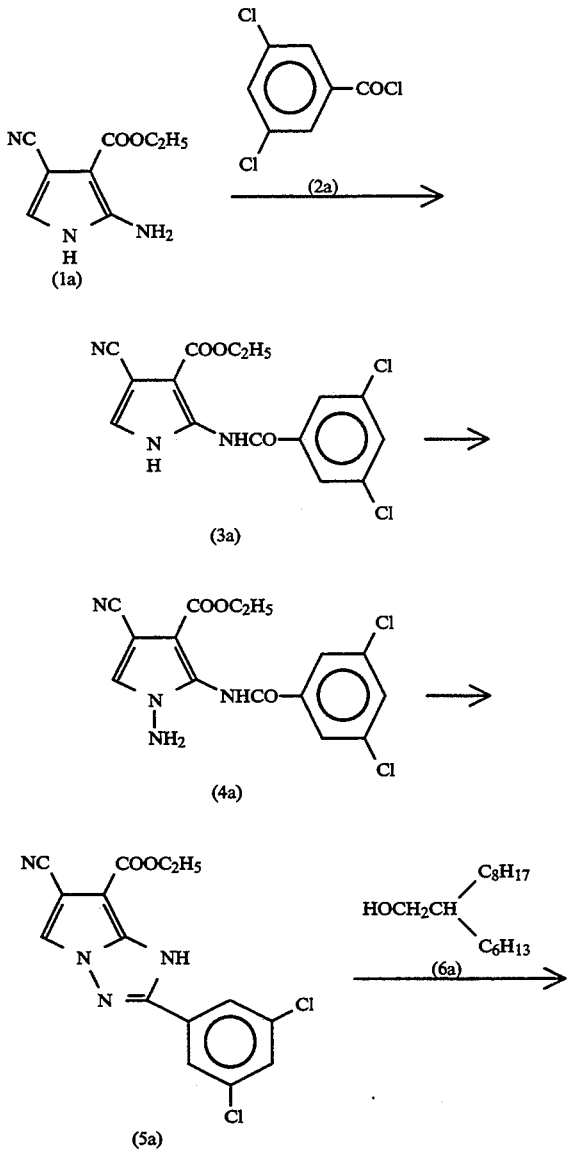

-continued

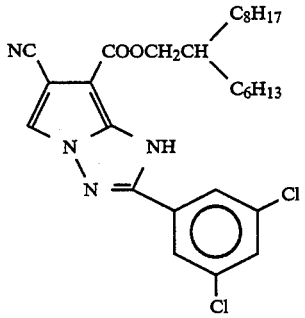

Exeplified Coupler (9)

Added to the dimethylacetamide (300 ml) solution of 2-amino-4-cyano-3-ethoxycarbonylpyrrole (1a) (66.0 g, 0.4 mole) was 3,5-dichlorobenzoyl chloride (2a) (83.2 g, 0.4 mole) at a room temperature, and stirring was applied for 30 minutes. Water was added and the solution was extracted twice with ethyl acetate. An organic phase was collected and washed with water and a saturated salt aqueous solution, followed by drying on sodium sulfate anhydrous. The solvent was distilled off under a reduced pressure and the residue was recrystallized from acetonitrile (300 ml), whereby the compound (3a) (113 g, 84%) was obtained.

The powder of potassium hydroxide (252 g, 4.5 mole) was added to the dimethylformamide (200 ml) solution of the compound (3a) (101.1 g, 0.3 mole) at a room temperature and stirred well. While cooling with water, hydroxylamine-o-sulfonic acid (237 g, 2.1 mole) was added a little at a time taking care so that the temperature of the reaction mixture did not suddenly rise, and after completing the addition, the solution was stirred for 30 minutes. A 0.1N hydrochloric acid aqueous solution was dropwise added to neutralize the solution (as tested with a pH test paper). The solution was extracted three times with ethyl acetate. The organic phase was washed with water and a saturated salt aqueous solution and then dried on sodium sulfate anhydrous. The solvent was distilled off under a reduced pressure and the residue was refined with a column chromatography (a spreading solvent, hexane:ethyl acetate=2:1), whereby the compound (4a) (9.50 g, 9%) was obtained.

Carbon tetrachloride (9 ml) was added to the acetonitrile (30 ml) solution of the compound (4a) (7.04 g, 20 mmole) at room temperature and subsequently triphenyl phosphine (5.76 g, 22 mmole) was added, followed by heating for refluxing for 8 hours. After cooling down, water was added and the solution was extracted with ethyl acetate three times. The organic phase was washed with water and a saturated salt aqueous solution and then dried on sodium sulfate anhydrous. The solvent was distilled off under a reduced pressure and the residue was refined with a silica gel column chromatography (a spreading solvent, hexane:ethyl acetate=4:1), whereby the compound (5a) (1.13 g, 17%) was obtained.

The compound (5a) thus obtained 1.8 g and the compound (6a) 12.4 g were dissolved in sulfolane 2.0 ml and further titanium isopropoxide 1.5 g was added thereto. The reaction was carried out for 1.5 hours while maintaining the reaction temperature at 110° C. and then ethyl acetate was added, followed by washing with water. After the ethyl acetate phase was dried, the solvent was distilled off and the residue was refined with a column chromatography, whereby the exemplified compound (9) 1.6 g was obtained. The melting point thereof was 97° to 98° C.

Where the cyan coupler of the present invention is applied to a silver halide color light-sensitive material, the material should have at least one layer containing the coupler of the present invention on a support. The layer containing the coupler of the present invention may be a hydrophilic layer provided on the support. In general, the color light-sensitive material can be of the constitution in which a blue-sensitive silver halide emulsion layer, a green-sensitive silver halide emulsion layer, and a red-sensitive silver halide emulsion layer are coated in this order on a support but the order may be different from this. Further, at least one of the above light-sensitive emulsion layers can be replaced with an infrared-sensitive silver halide emulsion layer. The silver halide emulsions having the sensitivities in the respective wavelength regions and the couplers forming the dyes having the relationship of a complementary color with the rays to which the emulsions are sensitive can be allowed to be contained in these light-sensitive emulsions to carry out a color reproduction by a subtractive color process. There may also be taken the constitution in which the light-sensitive emulsion layers do not have the above relationship with the hues of the dyes formed by the couplers.

Where the coupler of the present invention is applied to the light-sensitive material, it is used particularly preferably for a red-sensitive silver halide emulsion layer.

The addition amount of the coupler of the present invention to a light-sensitive material is usually $1\times10^{-3}$ to 1 mole, preferably $2\times10^{-3}$ to $5\times10^{-1}$ mole per mole of silver halide.

The preferred coating amount of the cyan coupler of the present invention is $2.0\times10^{-6}$ to $2.0\times10^{-3}$ mole, further preferably $2.0\times10^{-5}$ to $1.0\times10^{-3}$ mole per $m^2$ of the light-sensitive material. The cyan coupler of the present invention can be used by arbitrarily mixing the same with cyan couplers other than those of the present invention, but the use proportion of the cyan coupler of the present invention is preferably 5 mole % or more, further preferably 30 mole % or more.

The scarcely water soluble epoxy compound of the present invention having the group represented by Formula (AO) will be explained in further detail.

The scarcely water soluble epoxy compound is defined by the epoxy compound having the solubility in water of 10% or less at 25° C. and the sum of the number of carbon atoms is 9 or more, preferably 18 or more and further preferably 30 or more.

The alkyl group involved in Formula (AO) is a linear, branched or cyclic alkyl group (for example, methyl, ethyl, n-propyl, i-propyl, n-butyl, t-butyl, cyclohexyl, n-octyl, t-octyl, n-decyl, sec-dodecyl, n-hexadecyl, and n-octadecyl) and may further have a substituent.

The aryl group involved in Formula (AO) is an aromatic hydrocarbon group (for example, phenyl and naphthyl) and may further have a substituent.

The heterocyclic group involved in Formula (AO) is a 5- to 7-membered cyclic group in which at least one of the atoms constituting the ring is an atom selected from an oxygen atom, a nitrogen atom and a sulfur atom and may be an aromatic ring. It may further have a substitutent. There can be enumerated as the heterocyclic group, for example, thienyl, furyl, imidazolyl, pyrazolyl, pyrrolyl, indolyl, pyridyl, chromanyl, pyrazolidinyl, piperazinyl, 4-morpholinyl, and triazinyl.

There can be enumerated as the substitutent involved in Formula (AO), an alkyl group, an alkenyl group, an alkynyl group, an aryl group, a heterocyclic group, an alkoxy group, an aryloxy group, an alkylthio group, an arylthio group, a hydroxy group, a halogen atom, a cyano group, a nitro group, an acyl group, an acyloxy group, a silyloxy group, a sulfonyl group, a sulfonyloxy group, an alkoxycarbonyl group, an aryloxycarbonyl group, an amide group, an imide group, a carbamoyl group, a sulfamoyl group, a ureido group, a urethane group, an aminosulfamoyl group, an amino group, an alkylamino group, an arylamino group, and a heterocyclic amino group.

$R'_1$, $R'_2$, $R'_3$, $R'_4$ and $R'_5$ may be the same or different and each represent a hydrogen atom, an alkyl group or an aryl group. R' represents a substituent and n represents an integer of 0 to 4. When n is 2, 3 or 4, plural R's may be the same as or different from each other. —Y'— represents a divalent linkage group (for example, —O—, —S—, —$SO_2$—, —O—$CO_2$—, an imino group which may have a substituent, an alkylene group which may have a substituent, a phenylene group which may have a substituent, a naphthylene group, and a divalent heterocyclic group).

R'' in —N(R'')— for X' represents a hydrogen atom, an acyl group (for example, acetyl, acroyl and benzoyl), an alkylsulfonyl group (for example, methanesulfonyl, ethanesulfonyl and dodecanesulfonyl), an arylsulfonyl group (for example, benzenesulfonyl and toluenesulfonyl), an aryl group, a heterocyclic group, and —$C(R'_6)(R'_7)(R'_8)$.

The atom to which the group represented by Formula (AO) is bonded may be any of a hydrogen atom, a carbon atom, a nitrogen atom, a sulfur atom, and an oxygen atom.

The epoxy compound having the group represented by Formula (AO) is the compound having 3 or more groups, preferably 4 or more groups and more preferably 5 or more groups represented by Formula (AO) in terms of the effects of the present invention. Meanwhile, the epoxy compound having the group represented by Formula (AO) has preferably a sum number of benzene rings of 2 or more, further preferably 3 or more and more preferably 4 or more.

Of the epoxy compounds having the group represented by Formula (AO), the preferred compound is represented by the following Formula (AE-1), (AE-2), (AE-3), or (AE-4):

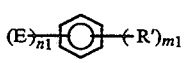

Formula (AE-1)

-continued

Formula (AE-2)

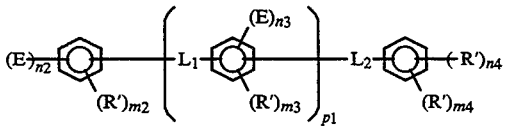

Formula (AE-3)

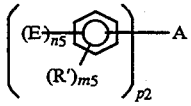

Formula (AE-4)

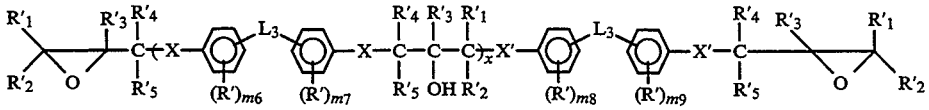

In Formulas (AE-1) to (AE-4), E represents the following Formula (AO-2):

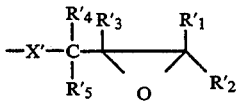

$R'_1$ to $R'_5$ and X' Formula (AO-2) represent the groups defined for $R'_1$ to $R'_5$ and X' in Formula (AO). In Formulas (AE-1) to and (AE-4), R' represents the group defined for R' in Formula (AO). $L_1$, $L_2$ and $L_3$ may be the same or different and each represents a divalent linkage group. An alkylene group which may have a substituent is preferred as $L_1$, $L_2$ and $L_3$ and the following structures can be given:

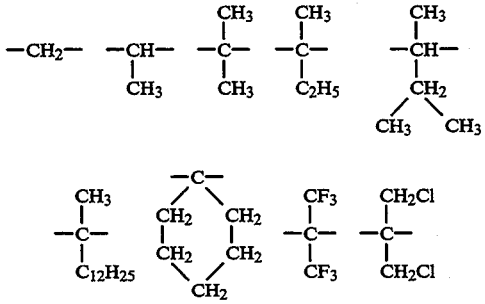

$n_1$ represents the integer of 3 to 6; $m_1$ represents the integer of 0 to 3; $n_2$ represents the integer of 1 to 5; $n_3$ represents the integer of 1 to 4; $n_4$ represents the integer of 1 to 5; $m_2$ represents the integer of 0 to 4; $m_3$ represents the integer of 0 to 3; $m_4$ represents the integer of 0 to 4; $n_5$ represents the integer of 1 to 5; $m_5$ represents the integer of 0 to 4; $m_6$ to $m_9$ represent the integer of 0 to 4; $p_1$ and x represent the real number of 0 to 20; $p_2$ represents the integer of 3 to 4; A represents a tri- to tetravalent organic group. A can have, for example, the following structures:

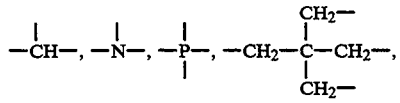

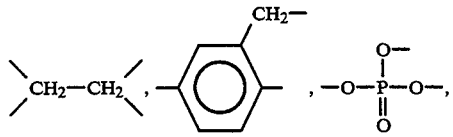

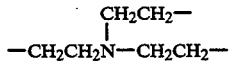

When a plurality of E and R' is present, plural Es may be the same or different and plural R's may be the same or different.

The compounds represented by Formulas (AE-2) and (AE-3) may be the mixture of the compounds each having the different numbers for $p_1$ and $p_2$.

Of the compounds represented by Formulas (AE-1) to (AE-4), preferred are those represented by Formulas (AE-1) to (AE-3), more preferably those represented by Formulas (AE-2) to (AE-3), and most preferably those represented by Formula (AE-2).

Of the compounds represented by Formula (AE-2), preferred are those in which E is represented by Formula (AO-2) and —X'— therein is represented by —O—; $p_1$ is preferably 1 to 20, further preferably 2 to 20, more preferably 3 to 20, and most preferably 4 to 20; $n_2$ to $n_4$ each are preferably 1 to 2; $m_2$ to $m_4$ each are preferably 0 to 3, most preferably 1 to 2; and R' is preferably an alkyl group, a halogen atom or an alkoxy group.

Exemplary compounds will be shown below but the present invention is not limited thereby.

(A-1)

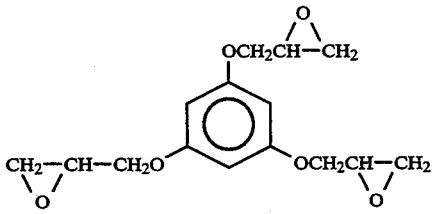

-continued
(A-2)
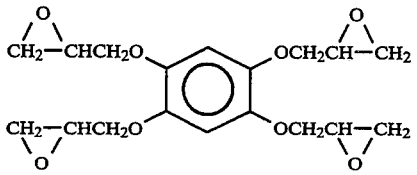
(A-3)
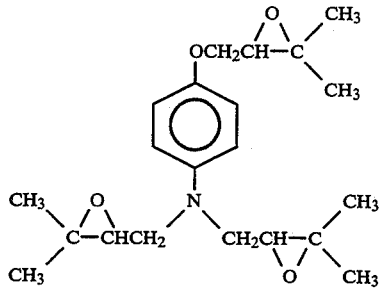
(A-4)
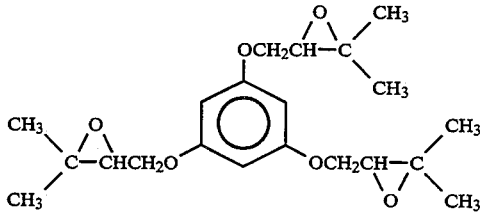
(A-5)
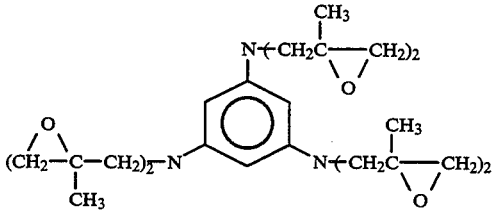
(A-6)
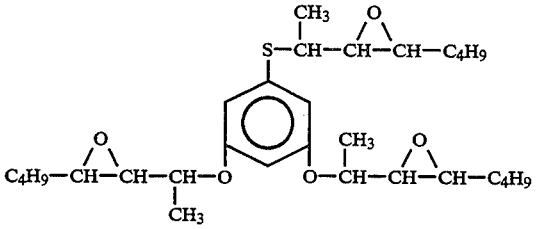
(A-7)
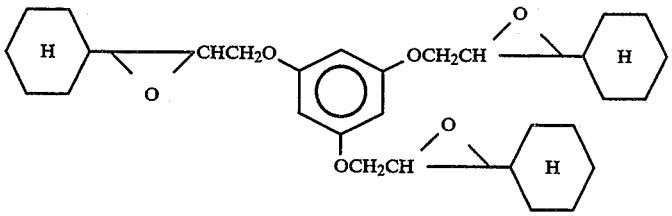
(A-8)
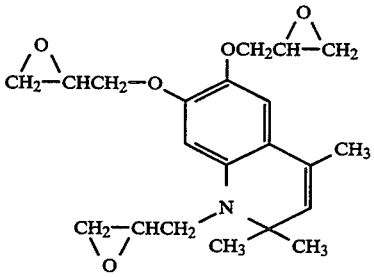

-continued
(A-9)
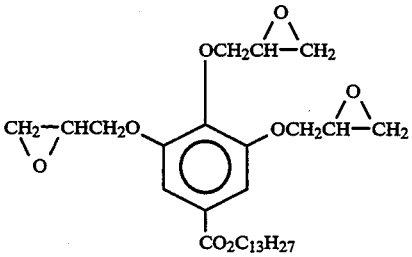
(A-10)
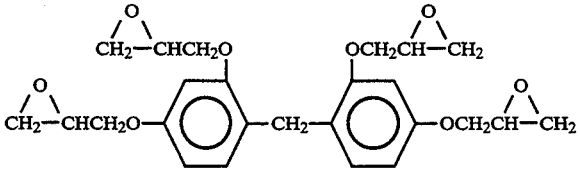
(A-11)
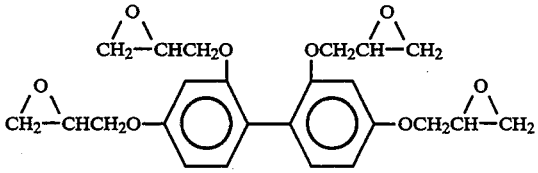
(A-12)
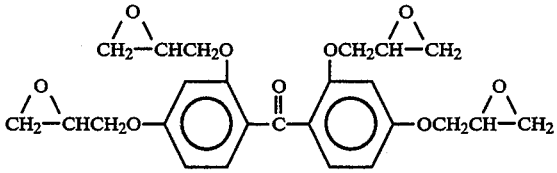
(A-13)
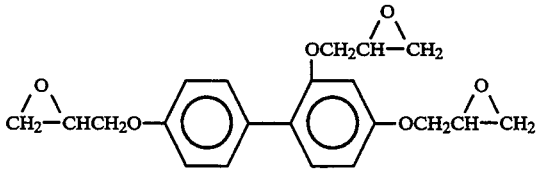
(A-14)
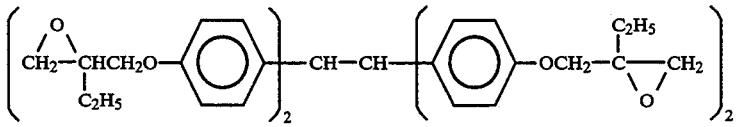
(A-15)
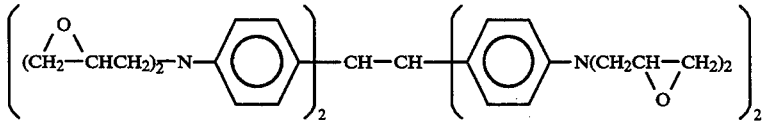
(A-16)
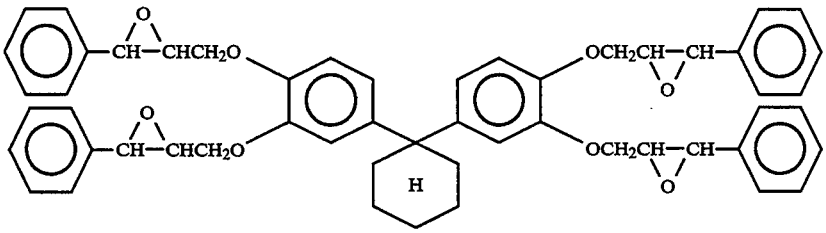
(A-17)
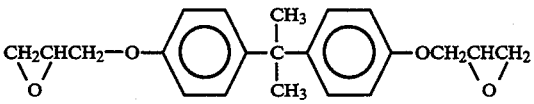

-continued
(A-18)
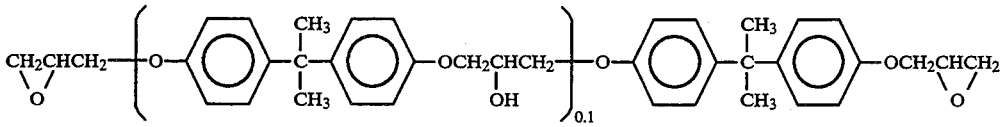
(A-19)
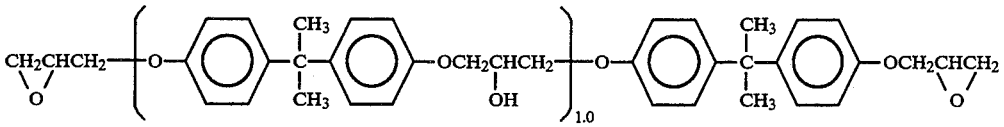
(A-20)
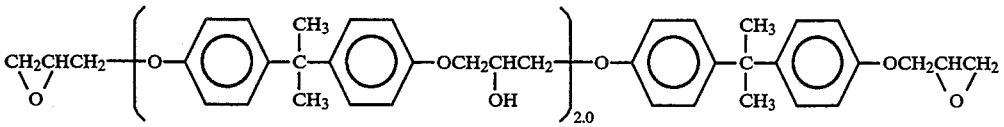
(A-21)
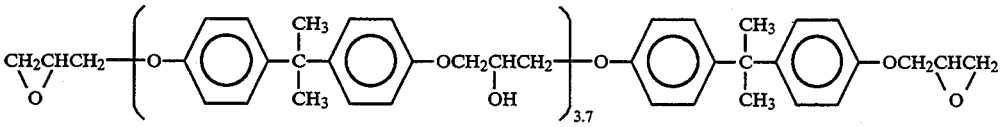
(A-22)
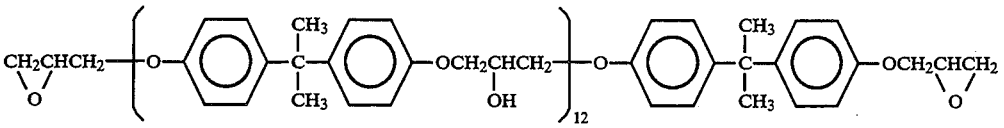
(A-23)
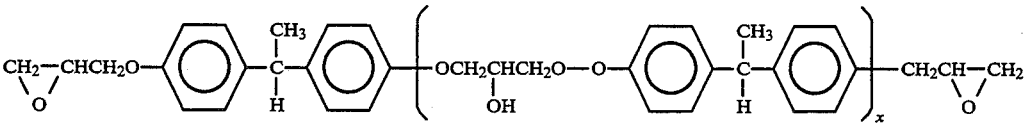
(A-24)
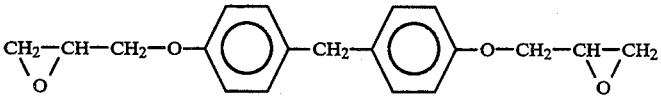
(A-25)
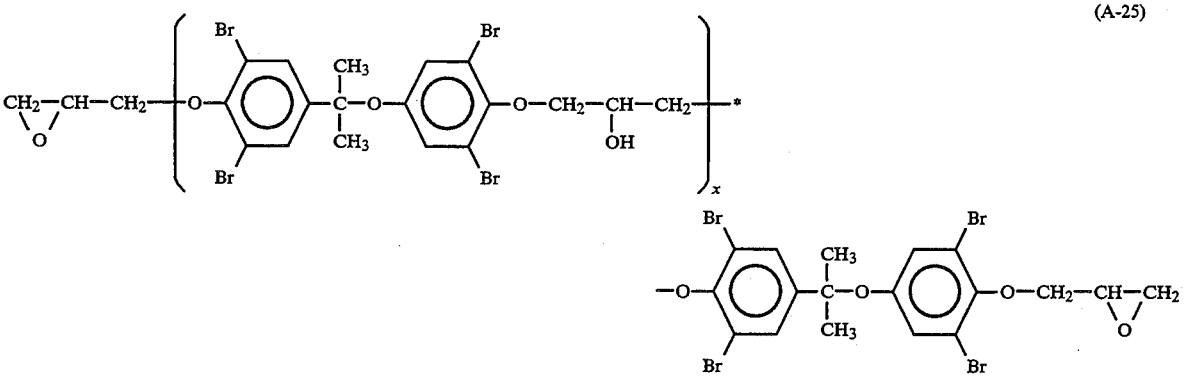
(A-26)
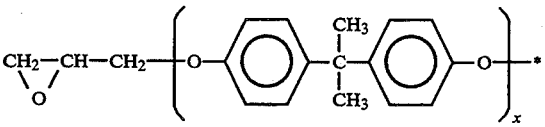

-continued
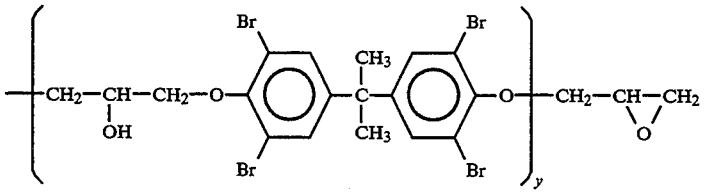
(A-27)
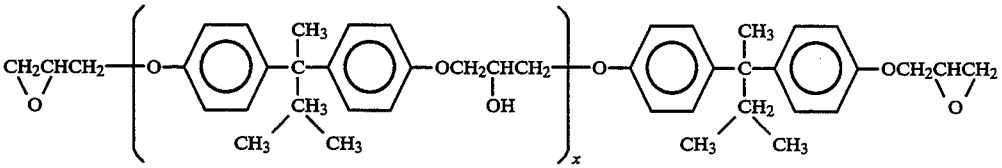
(A-28)
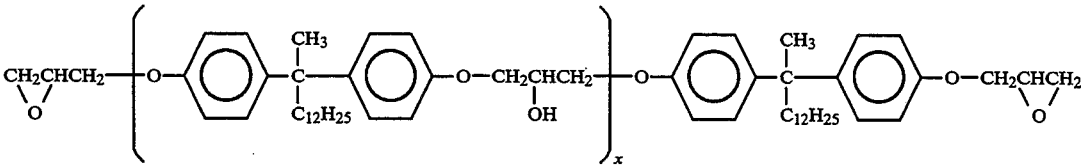
(A-29)
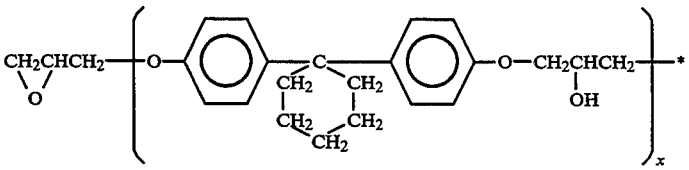
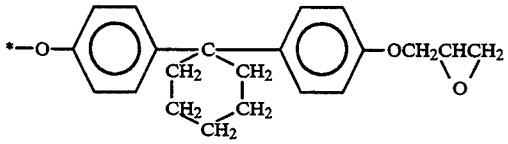
(A-30)
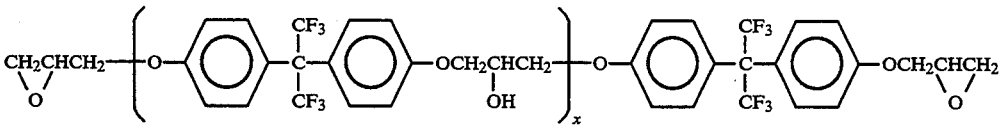
(A-31)
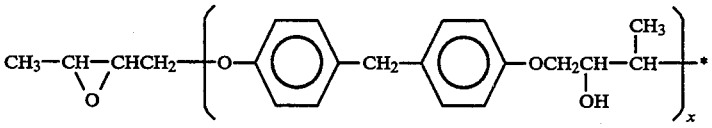
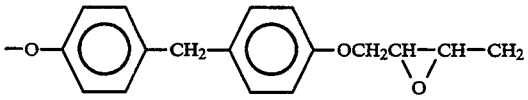
(A-32)
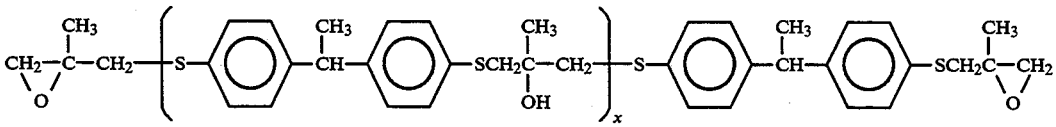
(A-33)
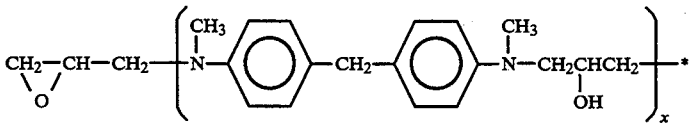

-continued
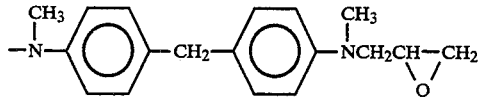
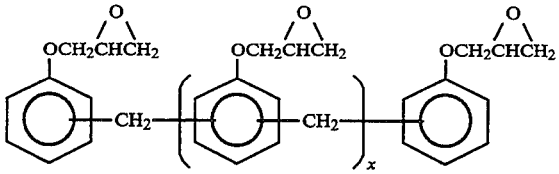
(A-34)
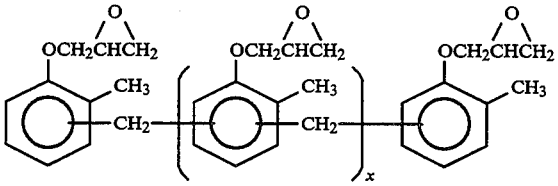
(A-35)
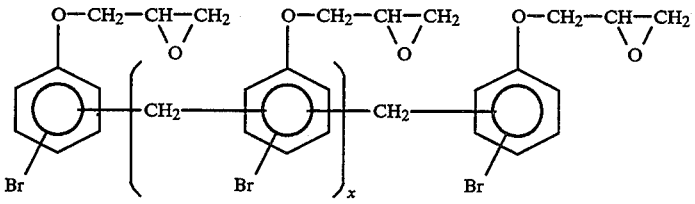
(A-36)
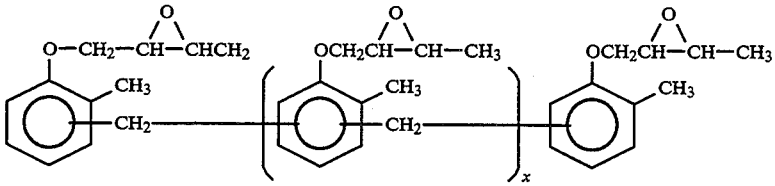
(A-37)
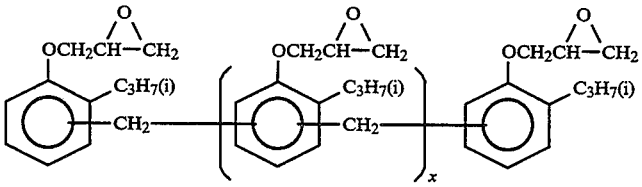
(A-38)
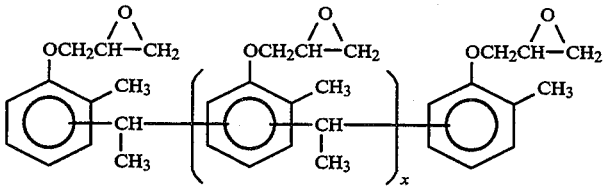
(A-39)
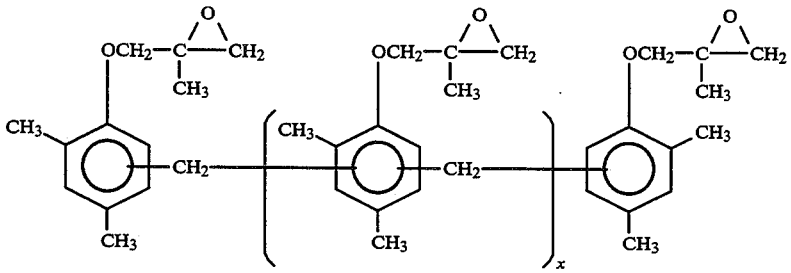
(A-40)

-continued
(A-41)
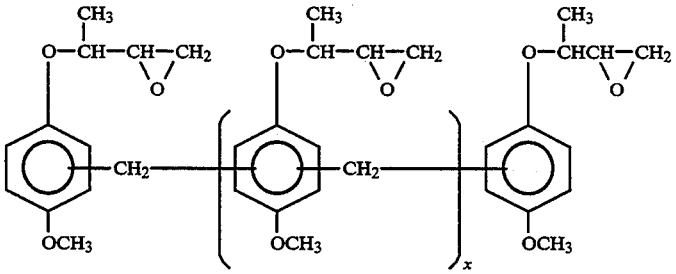
(A-42)
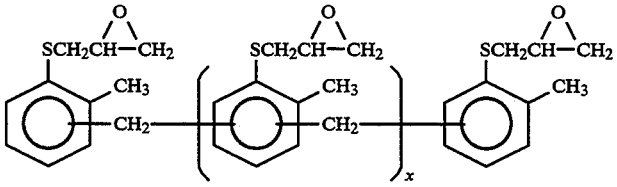
(A-43)
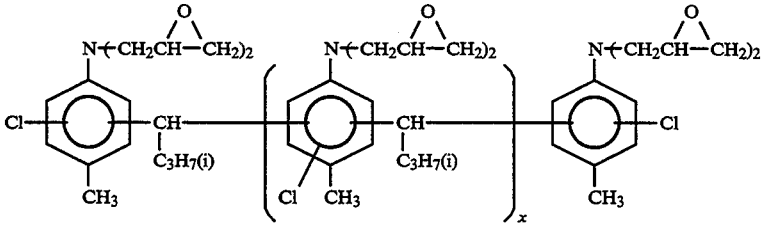
(A-44)
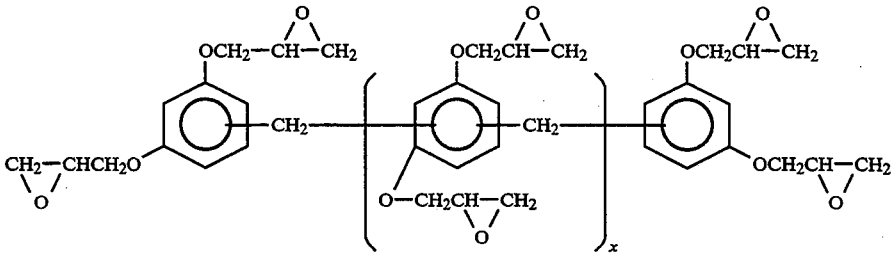
(A-45)
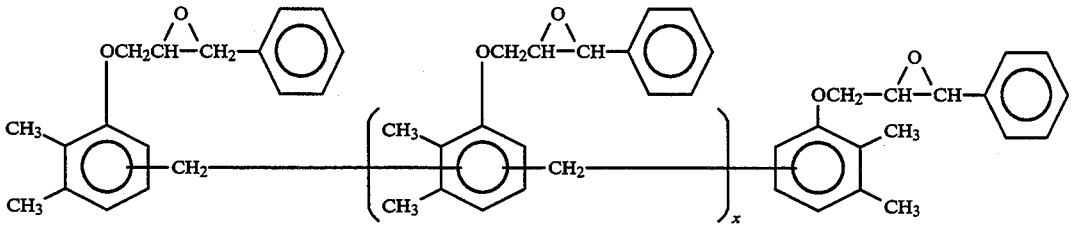
(A-46)
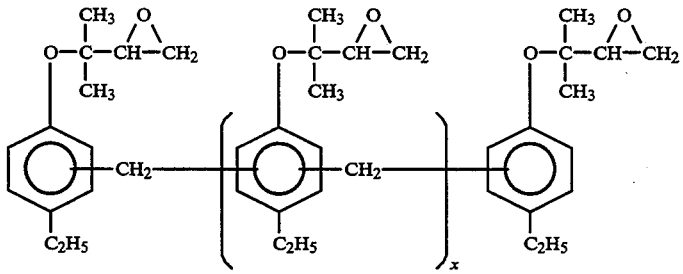
(A-47)
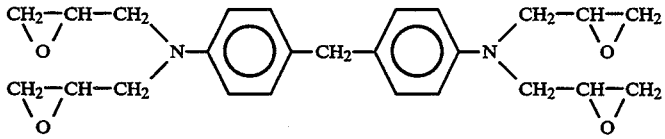

-continued (A-48)

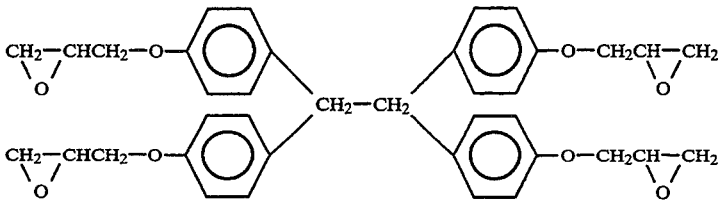

(A-49)

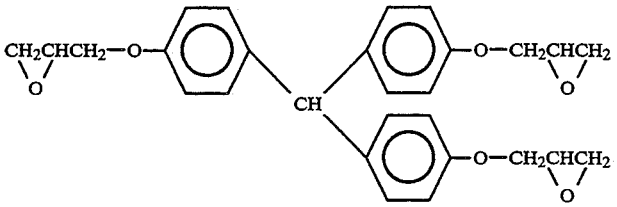

(A-50)

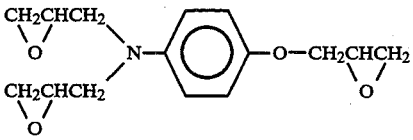

In the above structural formulas, the variables x and y each are real numbers and may be anyone as long as they fall within the range of 0 to 20. The values of x and y are not necessarily integers because there are sometimes involved compounds in which epoxy compounds having several kinds of the integers of x and y are mixed in some proportion and x and y are the averages thereof. These epoxy compounds may be used either singly or in combination of two or more kinds.

The epoxy compounds of the present invention can be used by emulsifying and dispersing in a hydrophilic binder such as a gelatin aqueous solution with a surface active agent. The epoxy compound of the present invention may be used as a high boiling solvent. It may be used in combination with a scarcely water soluble solvent having the boiling point of 160° C. or higher other than the epoxy compound of the present invention, a low boiling auxiliary organic solvent and/or a water soluble and organic solvent soluble polymer. In such a case, the epoxy compound of the present invention may coexist with a coupler and other additives for an emulsification-dispersion. The use amount of the high boiling solvent is generally 0 to 8 times, preferably 0 to 4 times based on the amount of the cyan coupler of the present invention in terms of a weight ratio. The examples of the high boiling solvent and polymer are preferably those disclosed in JP-A-64-537. The layer containing the dispersion of the scarcely water soluble epoxy compound and the layer containing a coupler dispersion may be different layers. The scarcely water soluble epoxy compound and coupler are emulsified and dispersed preferably in the same layer, particularly in the same oil drop.

The above epoxy compound used in the present invention can be obtained by reacting bisphenol A with epichlorhyrin under the presence of caustic soda (refer to "Plastic Material, Course (5) Epoxy Resin" written by N. Ohishi et al, published by Nikkan Daily Industrial News Paper).

The use amount of the epoxy compound of the present invention is 3 to 100%, more preferably 5 to 30% by weight based on the amount of the cyan coupler.

The layer to which the epoxy compound of the present invention is added may be any layer and is preferably a silver halide emulsion layer and/or a non-light-sensitive hydrophilic colloid layer adjacent to the silver halide emulsion layer, further preferably the light-sensitive silver halide emulsion layer containing a cyan coupler.

The color developing solution used in the present invention will be explained.

The replenishing amount of the developing solution used in the processing method according to the present invention is required to be settled in the range of 20 to 120 ml per $m^2$ of the silver halide light-sensitive material. In a continuous processing in which the replenishing amount exceeds 120 ml/$m^2$ of the light-sensitive material, the fastness of a cyan color dye is not markedly deteriorated but the degradation thereof is not preferred for the purpose of cutting down the discharge amount of a waste solution. Meanwhile, less replenishing amount of the developing solution is more preferred in terms of cutting down the discharge amount. However, in case that the replenishing amount of the developing solution is 20 ml or less per $m^2$ of the light-sensitive material, the amount of the processing solution carried over with the light-sensitive material exceeds the replenishing amount and the processing solution is decreased, which makes it practically impossible to carry out the continuous processing. The replenishing amount of 20 ml/$m^2$ of the light-sensitive material is almost equivalent to the amount of the processing solution carried over with the light-sensitive material, though it is a little different by light-sensitive material.

The replenishing amount of the color developing solution is 20 to 120 ml, preferably 30 to 100 ml/$m^2$ of the light-sensitive material. The replenishing amount described herein means the so-called replenished amount of the color developing solution and the amounts of the additives for correcting the amounts lost to an aging deterioration and a condensation are out of the replenishing amount according to the present invention. The additives described herein mean, for example, water for diluting a condensation, a preservative which is susceptible to an aging degradation and an alkali agent for raising pH.

A publicly known color developing agent can be used in the present invention. The use amount of the developing agent is preferably 0.002 to 0.2 mole, further preferably 0.005 to 0.1 mole per liter of the developing solution.

In embodying the present invention, the developing solution which does not substantially contain benzyl alcohol is preferably used from the viewpoint of an environmental problem, wherein "does not substantially contain" means that the concentration of benzyl alcohol is preferably 2 ml/liter or less, further preferably 0.5 ml/liter and that no benzyl alcohol is most preferably contained at all.

Where a high silver chloride emulsion having a silver chloride content of 90 mole % or more is used as a silver halide emulsion particularly for the purpose of a rapid processing, the method described in a left upper column at page 27 to a right upper column at page 34 of JP-A-2-207250 is preferably applied as the processing method for a silver halide color light-sensitive material.

There can be used as silver halide used in the present invention, silver chloride, silver bromide, silver bromochloride, silver bromoiodochloride, and silver bromoiodide. In particular, preferably used for the purpose of a rapid processing, a silver bromochloride or silver chloride emulsion containing substantially no silver iodide and having the silver chloride content of 90 mole % or more, further preferably 95 mole % or more, and particularly preferably 98 mole % or more.

For the purpose of improving the sharpness of an image, there are preferably incorporated into a hydrophilic colloid layer of the light-sensitive material according to the present invention so that the optical reflection density of the light-sensitive material in 680 nm becomes 0.70 or more, the dyes (among them, an oxonol series dye) capable of being decolored by processing, described at pages 27 to 76 of European Patent EP 0,337,490A2, and into an anti-water resin layer of a support, titanium oxide which is subjected to a surface treatment with di- to tetrahydric alcohols (for example, trimethylolethane) in the proportion of 12% by weight or more (more preferably 14% by weight or more).

With respect to an organic high boiling solvent for the photographic additives capable of being used in the present invention, such as the cyan, magenta and yellow couplers, any one can be used as long as they are compounds which have a melting point of 100° C. or less and a boiling point of 140° C. or more and which are immiscible with water and are good solvents for the couplers. The organic high boiling solvent has preferably a melting point of 80° C. or less. It has preferably a boiling point of 160° C. or more, more preferably 170° C. or more.

The details of these organic high boiling solvents are described in a right lower column at page 137 to the right upper column at page 144 of JP-A-62-215272.

The cyan, magenta and yellow couplers can be impregnated in a loadable latex polymer (for example, U.S. Pat. No. 4,203,716) or dissolved together with a water insoluble and organic solvent soluble polymer under the presence or absence of the above organic high boiling solvent to allow them to be emulsified and dispersed in a hydrophilic colloid aqueous solution.

Preferably used are the homopolymers or copolymers described at the 7th to 15th columns of U.S. Pat. No. 4,857,449 and at the pages of 12 to 30 of International Publication WO88/00723. A metacrylate series or acrylamide series polymer, particularly an acrylamide series polymer is preferably used in terms of the stabilization of a dye image.

Also, in the light-sensitive material according to the present invention, the color image preservability-improving compounds described in European Patent EP 0,277,589A2 are preferably used together with a coupler. In particular, they are used preferably in combination with a pyrazoloazole coupler and a pyrroloazole coupler.

That is, preferably used simultaneously or singularly for preventing side effects of, for example, the generation of stain due to the reaction of a color developing agent or the oxidation product thereof remaining in a layer during a storage after processing with a coupler, are the compounds (F) which are chemically combined with an aromatic amine series developing agent remaining after a color development processing to form a chemically inactive and substantially colorless compound, and/or the compounds (G) which are chemically combined with the oxidation product of the aromatic amine series developing agent remaining after the color development processing to form the chemically inactive and substantially colorless compound.

Further, the anti-mold agents described in JP-A-63-271247 are preferably added to the light-sensitive material according to the present invention for the purpose of preventing various molds and bacteria which grow in a hydrophilic colloid layer to deteriorate an image.

There are usually available as a support used in the present invention, a cellulose nitrate film, a cellulose acetate film, a cellulose acetate butylate film, a cellulose acetate propionate film, a polystyrene film, a polyethylene terephthalate film, a polycarbonate film, the laminated products thereof, a thin glass film, and paper each used for a photographic light-sensitive material. The good results can be given as well by the support such as baryta or α-olefin polymer-coated paper, particularly paper coated or laminated with the polymer of α-olefin having 2 to 12 carbon atoms, including polyethylene, polypropylene and an ethylene butene copolymer, a vinyl chloride resin containing a reflection material such as titanium oxide, and a plastic film which is improved in an adhesion performance with the other high molecular materials by roughing the surface thereof, as shown in JP-B-47-19068. Further, a UV-curable resin can be used as well.

Of these supports, a transparent one or opaque one is selected according to the object of a light-sensitive material. Further, a dye and a pigment can be added to make them colored and transparent.

There are included in the opaque support, in addition to a support which is inherently opaque like a paper, a support prepared by adding a dye and a pigment such as titanium oxide to a transparent film, a plastic film subjected to a surface treatment shown in JP-B-47-19068, and further a paper or plastic film to which carbon black and a dye are added to provide it with a light shielding performance. Among them, preferably used for the object of the present invention, a paper support laminated with polyolefin containing a pigment such as titanium oxide, and a reflection type polymer support containing such a pigment. A subbing layer is usually provided on the support. In order to further improve an adhesion performance, the surface of the support may be subjected to a preliminary treatment such as a corona discharge, a UV irradiation, and a flame treatment.

The light-sensitive material according to the present invention may be exposed with either a visible ray or an infrared ray. An exposing manner may be either a low illuminance exposure or a high illuminance and short time exposure. Particularly preferred for the present invention is an exposing system in which an exposing time per a picture element is shorter than $10^{-3}$ second and more preferred is a laser scanning exposing system in which an exposing time per a picture element is shorter than $10^{-4}$ second.

In exposure, a band stop filter described in U.S. Pat. No. 4,880,726 is preferably used, whereby a light mixture is removed to notably improve a color reproduction.

An exposed light-sensitive material can be subjected to a conventional color development processing and for the purpose of a rapid processing, it is preferably subjected to a bleach-fixing processing after the color development. Particularly where the above high silver chloride emulsion is used, the pH of the bleach-fixing solution is preferably 6.5 or less, more preferably about 6 or less for the purpose of accelerating desilver.

Those described in the following patent publications, particularly European Patent EP 0,355,660A2 (JP-A-2-139544) are preferably used as the silver halide emulsions, other materials (the additives) and photographic constitutional layers (a layer arrangement) applied to the light-sensitive material according to the present invention, and the processing methods and additives for processing, which are applied for processing this light-sensitive material:

| Photographic elements | JP-A-62-215272 | JP-A-2-33144 | EP 0355660A2 |
|---|---|---|---|
| Silver halide emulsion | p. 10, right upper column, line 6 to p. 12, left lower column, line 5, and p. 12, right lower column, line 4 from bottom to p. 13, left upper column, line 17. | p. 28, right upper column, line 16 to p. 29, right lower column, line 11, and p. 30, line 2 to 5. | p. 45, line 53 to p. 47, line 3, and p. 47, line 20 to 22. |
| Silver halide solvent | p. 12, left lower column, line 6 to 14, and p. 13, left upper column, line 3 from bottom to p. 18, left lower column, last line. | — | — |
| Chemical sensitizer | p. 12, left lower column, line 3 from bottom to right lower column, line 5 from bottom, and p. 18, right lower column, line 1 to p. 22, right upper column, line 9 from bottom. | p. 29, right lower column, line 12 to last line. | p. 47, line 4 to 9. |
| Spectral sensitizer (spectral sensitizing method) | p. 22, right upper column, line 8 from bottom to p. 38, last line. | p. 30, left upper column, line 1 to 13. | p. 47, line 10 to 15. |
| Emulsion stabilizer | p. 39, left upper column, line 1 to p. 72, right upper column, last line. | p. 30, left upper column, line 14 to right upper column, line 1. | p. 47, lines 16 to 19. |
| Development accelerator | p. 72, left lower column, line 1 to p. 91, right upper column, line 3. | — | — |
| Color coupler (cyan, magenta and yellow couplers) | p. 91 right upper column, line 4 to p. 121, left upper column, line 6. | p. 3, right upper column, line 14 to p. 18, left upper column, last line, and p. 30 right upper column, line 6 to p. 35 right lower column, line 11. | p. 4, lines 15 to 27, p. 5, line 30 to p. 28, last line p. 45, lines 29 to 31, and p. 47, line 23 to p. 63, line 50. |
| Color forming accelerator | p. 121, left upper column, line 7 to p. 125, right upper column, line 1. | — | — |
| UV absorber | p. 125, right upper column, line 2 to p. 127, left lower column, last line. | p. 37, right lower column, line 14 to p. 38, left upper column, line 11. | p. 65, line 22 to 31. |
| Anti-fading agent (an image stabilizer) | p. 127, right lower column, line 1 to p. 137, left lower column, line 8. | p. 36, right upper column, line 12 to p. 37, left upper column, line 19. | p. 4, line 30 to p. 5, line 23, p. 29, line 1 to p. 45, line 25, p. 45, line 33 to 40, and p. 65, lines 2 to 21. |
| High boiling and/or low boiling organic solvent | p. 137, left lower column, line 9 to p. 144, right upper, last line. | p. 35, right lower column, line 14 to p. 36, left upper, line 4. | p. 64, lines 1 to 51. |
| Method for dispersing photographic additives | p. 144, left lower column, line 1 to p. 146, right upper column, line 7. | p. 27, right lower column, line 10 to p. 28, left upper, last line, and p. 35, right lower column, line 12 to p. 36, right upper column, line 7. | p. 63, line 51 to. p. 64, line 56. |
| Hardener | p. 146. right upper column, line 8 to p. 155, left | — | — |

-continued

| Photographic elements | JP-A-62-215272 | JP-A-2-33144 | EP 0355660A2 |
|---|---|---|---|
| | lower column, line 4. | | |
| Precursor of a developing agent | p. 155, left lower column, line 5 to right lower column, line 2. | — | — |
| Development inhibitor-releasing compound | p. 155, right lower column, line 3 to 9. | — | — |
| Support | p. 155, right lower column, line 19 to p. 156, left upper column, line 14. | p. 38, right upper column, line 18 to p. 39, left upper column, line 3. | p. 66, line 29 to p. 67 line 13. |
| Light-sensitive layer structure | p. 156, left upper column, line 15 to right lower column, line 14. | p. 28, right upper column, lines 1 to 15. | p. 45, lines 41 to 52. |
| Dye | p. 156, right lower column, line 15 to p. 184, right lower column, last line. | p. 38, left upper column, line 12 to right upper column, line 7. | p. 66, lines 18 to 22. |
| Anti-color mixing agent | p. 185, left upper column, line 1 to p. 188, right lower column, line 3. | p. 36, right upper column, line 8 to 11. | p. 64, lines 57 to line 1. |
| Gradation controller | p. 188, right lower column, lines 4 to 8. | — | — |
| Anti-stain agent | p. 188, right lower column, line 9 to p. 193, right lower column, line 10. | p. 37, left upper column, last line to right lower column, line 13. | p. 65, line 32 to p. 66, line 17. |
| Surface active agent | p. 201, left lower column, line 1 to p. 210, right upper column, last line | p. 18, right upper column, line 1 to p. 24, right lower column, last line, and p. 27, left lower column, line 10 from bottom to right lower column, line 9. | — |
| Fluorinated compound (anti-electrification agent, coating aid, lubricant and anti-adhesion agent) | p. 210, left lower column, line 1 to p. 222, left lower column, line 5. | p. 25, left upper column, line 1 to p. 27, right lower column, line 9. | |
| Binder (hydrophilic colloid) | p. 222, left lower column, line 6 to p. 225, left upper column, last line | p. 38, right upper column, lines 8 to 18. | p. 66, lines 23 to 28. |
| Thickener | p. 225, right upper column, line 1 to p. 227, right upper column, line 2. | — | — |
| Anti-electrification agent | p. 227, right upper column, line 3 to p. 230, left upper column, line 1. | — | — |
| Polymer latex | p. 230, left upper column, line 2 to p. 239, last line | — | — |
| Matting agent | p. 240, left upper column, line 1 to right upper column, last line. | — | — |
| Photographic processing method (processing steps and additives) | p. 3, right upper column, line 7 to p. 10, right upper column, line 5. | p. 39, left upper column, line 4 to p. 42, left upper column, last line. | p. 67, line 14 to p. 69, line 28. |

Remarks:
1. There is included in the cited items of JP-A-62-215272, the content amended according to the Amendment of March 16, 1987.
2. Of the above color couplers, also preferably used are the so-called short wave type yellow couplers described in JP-A-63-231451, JP-A-63-123047, JP-A-63-241547, JP-A-1-173499, JP-A-213648, and JP-A-1-250944. Further, there can be preferably used the cycloalkane type acetanilide series yellow couplers described in JP-A-4-116643, and the indolinocarbonylanilide series yellow couplers described in EP 0,482,552.

EXAMPLES

The present invention will more concretely be explained below with reference to the following examples, but the invention is not limited thereto.

EXAMPLE 1

A paper support, laminated on the both sides with polyethylene, was subjected to a corona discharge treatment, and was provided with a gelatin subbing layer containing sodium dodecylbenzenesulfonate, and further was coated with various photographic constitutional layers, whereby a multilayered color photographic paper 1A having the following layer constitution was prepared. The coating solutions were prepared in the following manner.

Preparation of the fifth layer coating solution

Ethyl acetate 27.2 ml and the solvent (Solv-6) 7.0 g were added to the cyan coupler (ExC) 7.5 g, the dye image stabilizer (Cpd-6) 4.0 g, the dye image stabilizer (Cpd-7) 7.0 g, and the dye image stabilizer (Cpd-8) 0.9 g to dissolve them, and this solution was emulsified and dispersed in the 10% gelatin aqueous solution 185 ml containing a 10% sodium dodecylbenzenesulfonate aqueous solution 8 ml. Meanwhile, the red-sensitive sensitizing dye shown below was added to the silver bromochloride emulsion (cube, the 1:4 mixture (silver mole ratio) of the large size emulsion with the average grain size of 0.58 μm and the small size emulsion with the average grain size of 0.45 μm, wherein the fluctuation coefficients in the grain size distributions were 0.09 and 0.11, respectively, and either size emulsions contained the grains in which silver bromide 0.6 mol % was localized on a part of the grain surface and the rest was silver chloride) in the amounts of $0.9\times10^{-4}$ mole per mole of silver to the large size emulsion and $1.1\times10^{-4}$mole per mole of silver to the small size emulsion. Then, the emulsion was subjected to a sulfur sensitization and a gold sensitization.

The foregoing emulsified dispersion and this silver halide emulsion were mixed and dissolved, whereby the fifth layer coating solution was prepared so that it was of the following composition.

The coating solutions for the 1st layer to 4th layer, the 6th layer and the 7th layer were prepared in the same manner as that in the fifth layer coating solution. Sodium 1-oxy-3,5-dichloro-s-triazine was used as the hardener for the respective layers. Further, the following compound was added to all the coating solutions for the 1st layer to 7th layer in order to prevent a decomposition and the generation of mold:

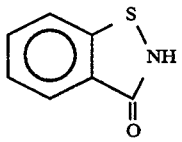

(25 mg/m²)

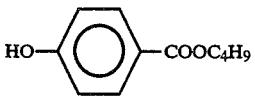

(25 mg/m²)

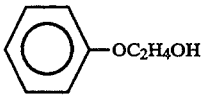

(500 mg/m²)

The following compounds were used as the spectral sensitizing dyes for the respective layers:

Blue-sensitive Emulsion Layer

-continued

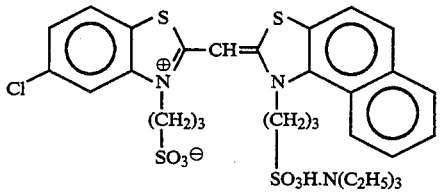

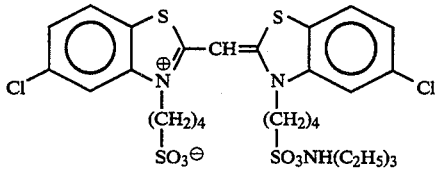

($2.0\times10^{-4}$ mol per mol of silver halide each for the large size emulsion and $2.5\times10^{-4}$ mol per mol of silver halide each for the small size emulsion)

Green-sensitive emulsion layer

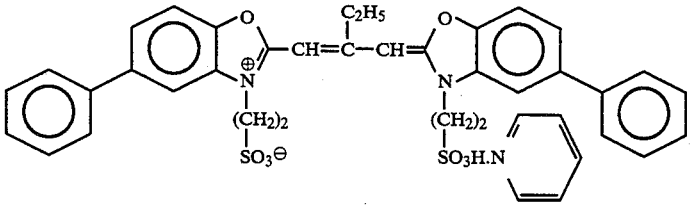

($4.0\times10^{-4}$ mol per mol of silver halide for the large size emulsion and $5.6\times10^{-4}$ mol per mol of silver halide for the small size emulsion)

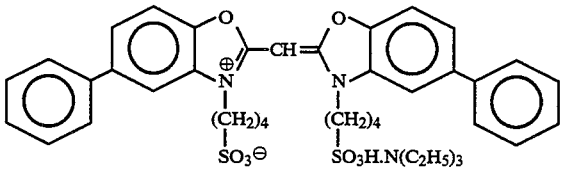

($7.0\times10^{-5}$ mol per mol of silver halide for the large size emulsion and $1.0\times10^{-4}$ mol per mol of silver halide for the small size emulsion)

Red-sensitive emulsion layer

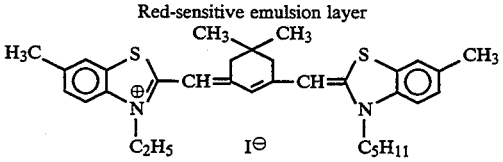

($0.9\times10^{-4}$ mol per mol of silver halide for the large size emulsion and $1.1\times10^{-4}$ mol per mol of silver halide for the small size emulsion)

The following compound was added to the red-sensitive emulsion layer in the amount of $2.6\times10^{-3}$ mole per mole of silver halide.

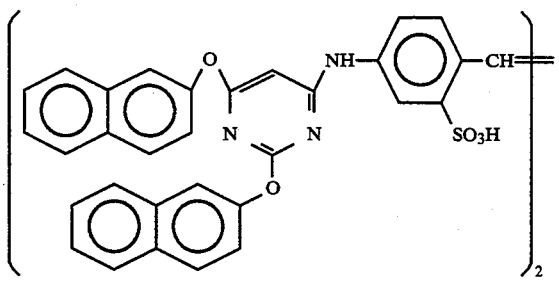

Further, 1-(5-methylureidophenyl)-5-mercaptotetrazole was added to the blue-sensitive emulsion layer, green-sensitive emulsion layer and red-sensitive emulsion layer in the amounts of $8.5\times10^{-5}$ mole, $7.7\times10^{-4}$ mole and $2.5\times10^{-4}$ mole per mole of silver halide, respectively. Further, 4-hydroxy-6-methyl-1,3,3a,7-tetraazaindene was added to the blue-sensitive emulsion layer and green-sensitive emulsion layer in the amounts of $1\times10^{-4}$ mole and $2\times10^{-4}$ mole per mole of silver halide, respectively.

The following dyes were added to the emulsion layers to prevent an irradiation:

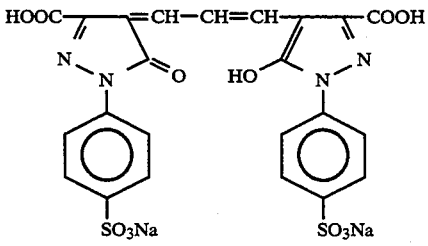

and

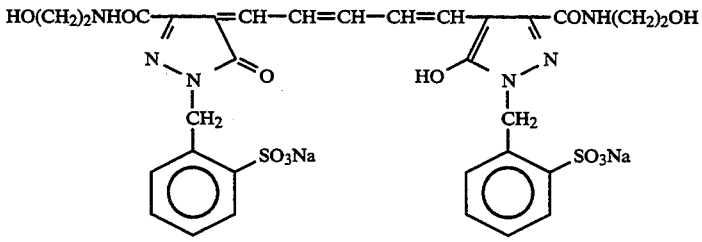

Layer constitution

The compositions of the respective layers are shown below. The numerals represent the coated amounts ($g/m^2$). The coated amounts of the silver halide emulsions are expressed in terms of the amounts converted to silver.

| Support: Polyethylene laminated paper [polyethylene coated on the 1st layer side contains a white pigment (titanium oxide) and a blue dye (ultramarine)]. | |
|---|---|
| First layer (a blue-sensitive emulsion layer): | |
| Silver bromochloride emulsion (cube, 3:7 mixture (Ag mole ratio) of the large size emulsion A having the average grain size of 0.88 μm and the small size emulsion A having the average grain size of 0.70 μm, wherein the fluctuation coefficients in the grain size distributions were 0.08 and 0.10, respectively, and either size emulsions comprised the grains in which silver bromide 0.3 mol % was localized on a part of the grain surface and the rest was silver chloride) | 0.30 |
| Gelatin | 1.86 |
| Yellow coupler (ExY) | 0.82 |
| Dye image stabilizer (Cpd-1) | 0.19 |
| Solvent (Solv-1) | 0.24 |
| Solvent (Solv-3) | 0.11 |
| Dye image stabilizer (Cpd-7) | 0.06 |
| Second layer (an anti-color mixing layer): | |
| Gelatin | 0.99 |
| Anti-color mixing agent (Cpd-5) | 0.08 |
| Solvent (Solv-1) | 0.16 |
| Solvent (Solv-4) | 0.08 |
| Third layer (a green-sensitive emulsion layer): | |
| Silver bromochloride emulsion (cube, 1:3 mixture (Ag mole ratio) of the large size emulsion having the average grain size of 0.55 μm and the small size emulsion having the average grain size of 0.39 μm, wherein the fluctuation coefficients in the grain size distributions were 0.10 and 0.08, respectively, and either size emulsions comprised the grains in which silver bromide 0.8 mol % was localized on a part of the grain surface and the rest was silver chloride) | 0.12 |
| Gelatin | 1.24 |
| Magenta coupler (ExM) | 0.20 |
| Dye image stabilizer (Cpd-2) | 0.03 |
| Dye image stabilizer (Cpd-3) | 0.15 |
| Dye image stabilizer (Cpd-4) | 0.02 |
| Dye image stabilizer (Cpd-9) | 0.02 |
| Solvent (Solv-2) | 0.40 |
| Fourth layer (a UV absorbing layer): | |
| Gelatin | 1.58 |
| UV absorbing agent (UV-1) | 0.47 |
| Anti-color mixing agent (Cpd-5) | 0.05 |
| Solvent (Solv-5) | 0.24 |
| Fifth layer (a red-sensitive emulsion layer): | |
| Silver bromochloride emulsion (cube, 1:4 mixture (Ag mole ratio) of the large size emulsion having the average grain size of 0.58 μm and the | 0.23 |

-continued

Support:
Polyethylene laminated paper
[polyethylene coated on the 1st layer side contains a white pigment (titanium oxide) and a blue dye (ultramarine)].

small size emulsion having the average grain size of 0.45 μm, wherein the fluctuation coefficients in the grain size distributions were 0.09 and 0.11, respectively, and either size emulsions comprised the grains in which silver bromide 0.6 mol % was localized on a part of the grain surface and the rest was silver chloride)

| | |
|---|---|
| Gelatin | 1.34 |
| Cyan coupler (ExC) | 0.32 |
| Dye image stabilizer (Cpd-6) | 0.17 |
| Dye image stabilizer (Cpd-7) | 0.30 |
| Dye image stabilizer (Cpd-8) | 0.04 |
| Solvent (Solv-6) | 0.30 |
| Sixth layer (a UV absorbing layer): | |
| Gelatin | 0.53 |
| UV absorber (UV-1) | 0.16 |
| Anti-color mixing agent (Cpd-5) | 0.02 |
| Solvent (Solv-5) | 0.08 |
| Seventh layer (a protective layer): | |
| Gelatin | 1.33 |
| Acryl-modified copolymer of polyvinyl alcohol (a modification degree: 17%) | 0.17 |
| Liquid paraffin | 0.03 |

(ExY) Yellow coupler
1:1 mixture (mole ratio) of

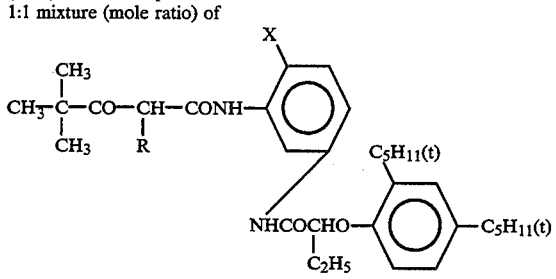

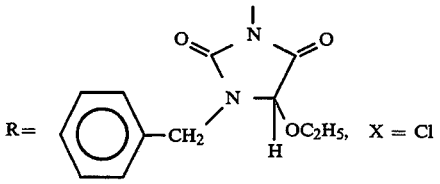

and

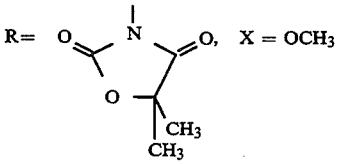

(ExM) Magenta coupler
1:1 mixture (mole ratio) of

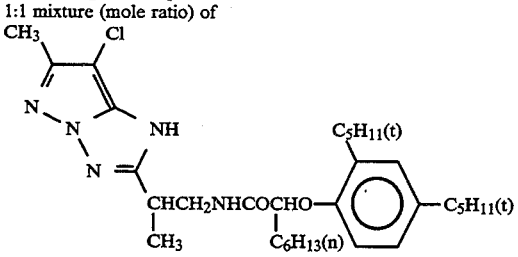

-continued

Support:
Polyethylene laminated paper
[polyethylene coated on the 1st layer side contains a white pigment (titanium oxide) and a blue dye (ultramarine)].

and

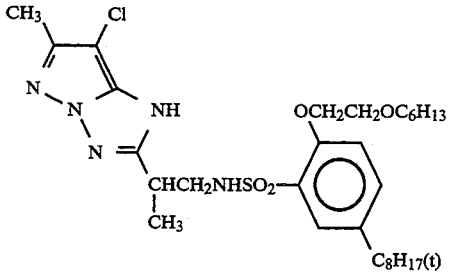

(ExC) Cyan-coupler
2:4:4 (weight ratio) mixture of

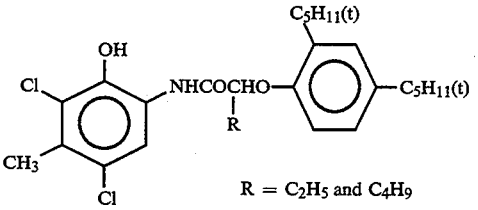

R = $C_2H_5$ and $C_4H_9$ and

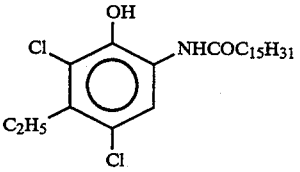

(Cpd-1) Dye image stabilizer

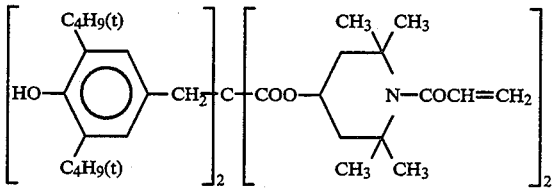

(Cpd-2) Dye image stabilizer

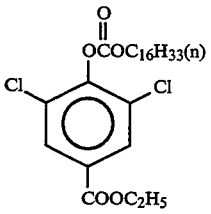

(Cpd-3) Dye image stabilizer

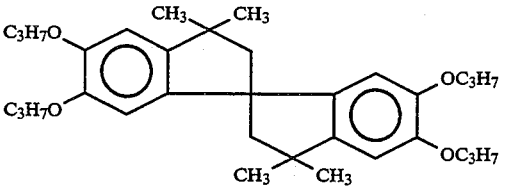

-continued

Support:
Polyethylene laminated paper
[polyethylene coated on the 1st layer side contains a white pigment (titanium oxide) and a blue dye (ultramarine)].

(Cpd-4) Dye image stabilizer

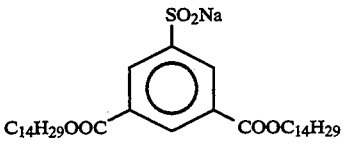

(Cpd-5) Anti-color mixing agent

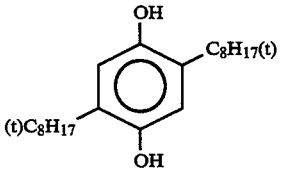

(Cpd-6) Dye image stabilizer
2:4:4 (weight ratio) mixture of

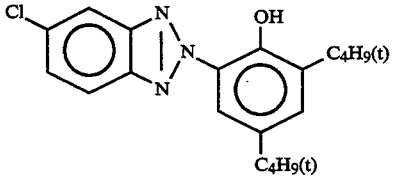

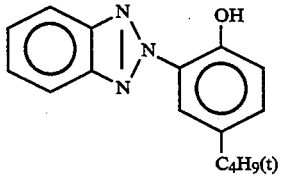

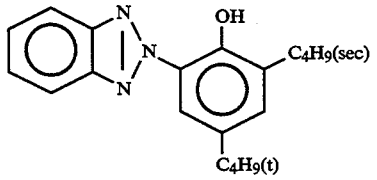

(Cpd-7) Dye image stabilizer

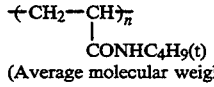

(Average molecular weight: 60,000)

(Cpd-8) Dye image stabilizer

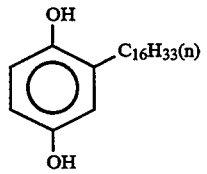

(Cpd-9) Dye image stabilizer

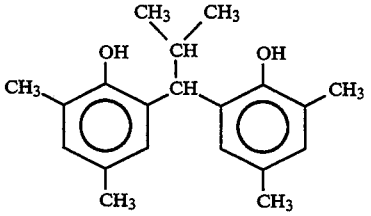

(UV-1) UV absorber
4:2:4 (weight ratio) mixture of

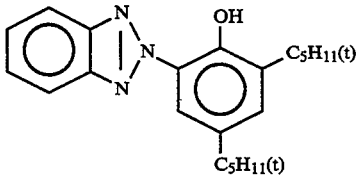

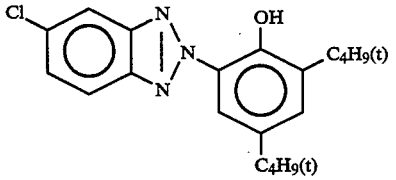

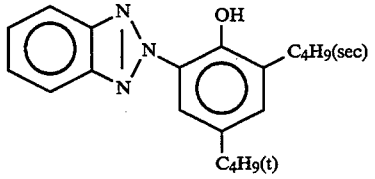

(Solv-1) Solvent

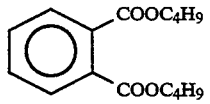

(Solv-2) Solvent
2:1 (volume ratio) mixture of

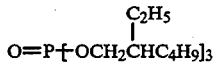

and

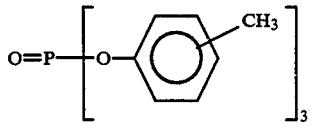

(Solv-3) Solvent (Solv-4) Solvent

-continued

Support:
Polyethylene laminated paper
[polyethylene coated on the 1st layer side contains a white pigment (titanium oxide) and a blue dye (ultramarine)].

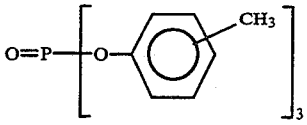

(Solv-5) Solvent

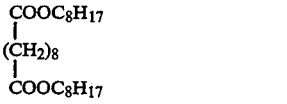

(Solv-6) Solvent

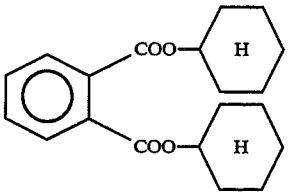

Further, the comparative color photographic papers 101 to 105 having the similar compositions to that of Sample 1A were prepared as shown in Table 1 in the same manner as that in Sample 1A except that the solvent (Solv-6) used in the fifth layer (the red-sensitive emulsion layer) was replaced with the epoxy compound or comparative compound described in Table 1 in the prescribed amount and/or the cyan coupler (ExC) used in the fifth layer (the red-sensitive emulsion layer) was replaced with the same mole of the cyan coupler of the present invention and that the coated amount in the fifth layer was reduced to 60%.

The color photographic papers 106 to 120 of the present invention having the similar compositions to that of Sample 1A were prepared as shown in Table 1 in the same manner as that in Sample 1A except that the solvent (Solv-6) used in the fifth layer (the red-sensitive emulsion layer) was replaced with the various epoxy compounds of the present invention in the prescribed amounts and the cyan coupler (ExC) used in the fifth layer (the red-sensitive emulsion layer) was replaced with the same mole of the various cyan couplers of the present invention and that the coated amount in the fifth layer was reduced to 60%.

TABLE 1

| Color photographic paper | Epoxy compound | | Cyan coupler |
|---|---|---|---|
| | Compound No. | Substitution*1 | |
| 101 (Comp.) | A-18 | 50 | ExC |
| 102 (Comp.) | A-21 | 80 | ExC |
| 103 (Comp.) | Comparative Compound Cpd-19*2 | 50 | C-4 |
| 104 (Comp.) | Comparative Compound Cpd-20*2 | 50 | C-10 |
| 105 (Comp.) | — | 0 | C-10 |
| 106 (Inv.) | A-18 | 80 | C-2 |
| 107 (Inv.) | A-26 | 50 | C-4 |
| 108 (Inv.) | A-34 | 80 | C-10 |
| 109 (Inv.) | A-34 | 50 | C-10 |
| 110 (Inv.) | A-34 | 50 | C-17 |
| 111 (Inv.) | A-34 | 50 | C-11 |
| 112 (Inv.) | A-35 | 80 | C-11 |

TABLE 1-continued

| Color photographic paper | Epoxy compound | | Cyan coupler |
|---|---|---|---|
| | Compound No. | Substitution*1 | |
| 113 (Inv.) | A-35 | 50 | C-11 |
| 114 (Inv.) | A-35 | 50 | C-12 |
| 115 (Inv.) | A-35 | 20 | C-13 |
| 116 (Inv.) | A-35 | 20 | C-19 |
| 117 (Inv.) | A-37 | 50 | C-35 |
| 118 (Inv.) | A-47 | 50 | C-10 |
| 119 (Inv.) | A-48 | 80 | C-11 |
| 120 (Inv.) | A-48 | 50 | C-21 |

Note:
*1Substitution rate (%) of Solv-6 with the epoxy compound
*2Comparative compound (Cpd-19)

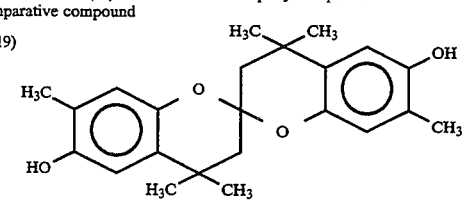

(Cpd-20)

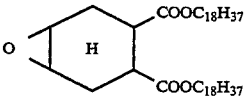

First, each of the samples was subjected to a gradational exposure via a three colors separation filter for a sensitometry with a sensitometer (an FWH type, the color temperature of a light source: 3200° K., manufactured by Fuji Photo Film Co., Ltd.), wherein the exposure was given so that an exposure became 250 CMS at the exposing time of 0.1 second.

The samples thus exposed were subjected to the color development with a paper processing machine at the following processing steps.

Processing step

| Step | Temperature (°C.) | Time | Tank capacity (l) |
|---|---|---|---|
| Color developing | 35 | 45 seconds | 1.7 |
| Bleach-fixing | 30 to 35 | 45 seconds | 1.7 |
| Rinsing (1) | 30 to 35 | 20 seconds | 1.0 |
| Rinsing (2) | 30 to 35 | 20 seconds | 1.0 |
| Rinsing (3) | 30 to 35 | 20 seconds | 1.0 |
| Drying | 70 to 80 | 60 seconds | |

The compositions of the respective tank solutions are as follows:

| | Amount |
|---|---|
| Color developing solution | |
| Water | 800 ml |
| Ethylenediamine-N,N,N',N'-tetramethylenephosphonic acid | 1.5 g |
| Potassium bromide | * |
| Triethanolamine | 8.0 g |
| Sodium chloride | ** |
| Potassium carbonate | 25 g |
| N-ethyl-N-(β-methanesulfonamidethyl)-3-methyl-4-aminoaniline sulfate | 5.0 g |
| N,N-bis(carboxymethyl) hydrazine | 5.5 g |
| Fluorescent whitening agent (Whitex 4B manufactured by Sumitomo Chem. Ind. Co., Ltd.) | 1.0 g |
| Water was added to | 1000 ml |
| pH (25° C.) | 10.05 |
| Bleach/fixing solution (the tank solution was common to the replenishing solution) | |

-continued

| | Amount |
|---|---|
| Water | 400 ml |
| Ammonium thiosulfate (70%) | 100 ml |
| Sodium sulfite | 17 g |
| Iron (III) ammonium ethylenediamine-tetracetate | 55 g |
| Disodium ethylenediaminetetracetate | 5 g |
| Ammonium bromide | 40 g |
| Water was added to | 1000 ml |
| pH (25° C.) | 6.0 |
| Rinsing solution (the tank solution was common to the replenishing solution) | |
| Deionized water (the contents of calcium and magnesium: each 3 ppm or less) | |

*The amount of potassium bromide was adjusted so that the $Br^-$ concentration in the tank became $1.26 \times 10^{-4}$ mol/l where the replenishing solution a was used and $2.5 \times 10^{-4}$ mol/l where the replenishing solution b or c was used.
**The amount of sodium chloride was adjusted so that the $Cl^-$ concentration in the tank became $2.4 \times 10^{-2}$ mol/l, $4.2 \times 10^{-2}$ mol/l and $1.0 \times 10^{-2}$ mol/l, respectively, where the replenishing solutions a, b and c were used.

The compositions of the replenishing solutions are as follows:

| Composition of replenishing solution | Replenishing solution a | b | c |
|---|---|---|---|
| Ethylenediamine-N,N,N',N'-tetramethylenephosphonic acid | 3 g/l | 3 g/l | 3 g/l |
| Triethanolamine | 12 g/l | 12 g/l | 12 g/l |
| Potassium carbonate | 26 g/l | 26 g/l | 26 g/l |
| N-ethyl-N-(β-methanesulfonamidethyl)-3-methyl-4-aminoaniline sulfate | 7 g/l | 11 g/l | 12 g/l |
| Diethylhydroxylamine | 6 g/l | 7.5 g/l | 8 g/l |
| Fluorescent whitening agent (Whitex-4 manufactured by Sumitomo Chem. Ind. Co., Ltd.) | 1.5 g/l | 2 g/l | 2.5 g/l |
| pH (adjusted with KCl or $H_2SO_4$; 25° C.) | 10.45 | 10.60 | 11.00 |
| Replenishing amount*** | 160 ml | 90 ml | 70 ml |

***the replenishing amount: per $m^2$ of the light sensitive material.

The compositions of the replenishing solutions were settled as shown above (the replenishing amounts of the bleach-fixing solution and rinsing solution were the same as those of the tank capacities) and the replenishing amounts per $m^2$ of the light-sensitive material were set at 160 ml, 90 ml and 70 ml for the color developing solution, 61 ml for the bleach-fixing solution, and 364 ml for the rinsing solution (provided that the rinsing solution was replenished to the tank (3) and of a countercurrent system from the tank (3) to the tank (1); and the rinsing solution (1) was replenished to the bleach-fixing tank in the amount of 122 ml per $m^2$ of the light-sensitive material). Sample 1A was used for a color photographic paper and a continuous processing was carried out in three kinds of the replenishing amounts until the two times replenishing solution as much as the tank capacity of the color developing solution was consumed. The exposed samples of the invention and comparison were subjected to these three kinds of processings after finishing the continuous processing with Sample 1A.

Each of the samples thus processed was subjected to the measurement of a reflection density to obtain a characteristic curve. The fastness of a cyan dye image was evaluated with the fading rates (%) of the dye image at the initial densities of 0.5 and 1.5 after the photographic paper was left for standing in a dark room at 80° C. and 70% RH and the fading rate (%) of the dye image at the initial density of 1.5 after the photographic paper was irradiated with a xenon light (100,000 lux) for 5 days. The fading rate can be calculated from the equation of (density reduction amount/initial density)×100 and shows that the smaller the value is, the more excellent the image storing performance is.

The above results are shown in Table 2.

TABLE 2

| | Dark fading at 80° C. & 70% RH for 5 days | | | | | | Light fading with Xe for 5 days | | |
|---|---|---|---|---|---|---|---|---|---|
| | Replenishing solution a | | Replenishing solution b | | Replenishing solution c | | Replenishing solution a | Replenishing solution b | Replenishing solution c |
| | Replenishing amount*** | | | | | | Replenishing amount*** | | |
| | 160 ml | | 90 ml | | 70 ml | | 160 ml | 90 ml | 70 ml |
| Sample No. | D = 0.5* | D = 1.5** | D = 0.5* | D = 1.5** | D = 0.5* | D = 1.5** | D = 1.5** | D = 1.5** | D = 1.5** |
| 101 (Comp.) | 33 | 35 | 40 | 42 | 40 | 44 | 14 | 16 | 17 |
| 102 (Comp.) | 32 | 36 | 37 | 42 | 37 | 43 | 15 | 18 | 18 |
| 103 (Comp.) | 25 | 17 | 37 | 24 | 38 | 26 | 17 | 19 | 20 |
| 104 (Comp.) | 27 | 19 | 35 | 25 | 37 | 25 | 17 | 19 | 19 |
| 105 (Comp.) | 51 | 25 | 51 | 25 | 51 | 25 | 23 | 25 | 25 |
| 106 (Inv.) | 22 | 18 | 22 | 18 | 23 | 18 | 14 | 14 | 14 |
| 107 (Inv.) | 23 | 19 | 24 | 19 | 24 | 20 | 15 | 15 | 15 |
| 108 (Inv.) | 21 | 18 | 21 | 18 | 21 | 19 | 13 | 14 | 14 |
| 109 (Inv.) | 24 | 20 | 26 | 20 | 28 | 22 | 13 | 13 | 13 |
| 110 (Inv.) | 22 | 17 | 23 | 17 | 23 | 17 | 14 | 14 | 14 |
| 111 (Inv.) | 22 | 16 | 22 | 17 | 22 | 17 | 14 | 14 | 14 |
| 112 (Inv.) | 24 | 17 | 25 | 18 | 25 | 18 | 12 | 12 | 13 |
| 113 (Inv.) | 23 | 17 | 23 | 19 | 24 | 19 | 13 | 13 | 13 |
| 114 (Inv.) | 26 | 19 | 26 | 21 | 26 | 20 | 13 | 14 | 14 |
| 115 (Inv.) | 24 | 19 | 24 | 19 | 25 | 20 | 15 | 15 | 15 |
| 116 (Inv.) | 26 | 20 | 27 | 20 | 27 | 20 | 16 | 16 | 16 |
| 117 (Inv.) | 23 | 18 | 23 | 19 | 24 | 19 | 14 | 14 | 14 |
| 118 (Inv.) | 24 | 17 | 24 | 17 | 25 | 17 | 13 | 13 | 13 |
| 119 (Inv.) | 20 | 15 | 20 | 16 | 20 | 16 | 12 | 12 | 12 |
| 120 (Inv.) | 23 | 18 | 23 | is | 25 | 19 | 14 | 14 | 14 |

*fading rate (%) at the initial density of 0.5.
**fading rate (%) at the initial density of 1.5.
***per $m^2$ of the light-sensitive material.

As apparent from the results summarized in Table 2, it has been confirmed that the cyan dye images on the color photographic papers 106 to 120 of the invention have excellent image storing performances compared with those of the comparative samples 101 to 105. In particular, it can be found that in the color photographic papers of the invention, the fading due to a high humidity and a high temperature is improved over a low color-developed density portion to a high color-developed density compared with those of the comparative samples and that the performances thereof are maintained without depending on the replenishing amounts of the processing solutions.

Further, the samples were prepared in the same manner as that in Samples 106 to 120 of the invention except that the yellow coupler (ExY) contained in the first layer was replaced with the same mole of the yellow coupler (ExY-II) or (ExY-III) described below and further the whole coated amount in the first layer was reduced to 80 weight % or 70 weight %. It was confirmed that the same effects as those mentioned above could be obtained as well in these samples.

(ExY-II) yellow coupler

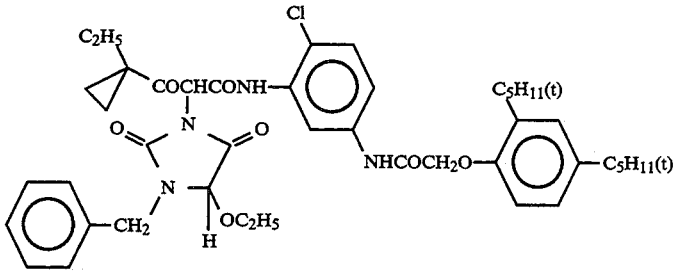

(ExY-III) yellow coupler

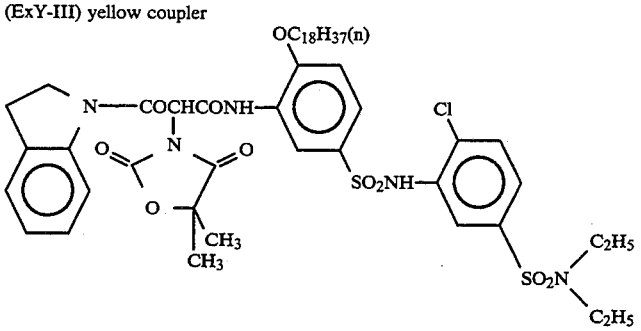

Further, it was visually confirmed that either of the color photographic papers of the invention had a brilliant cyan color.

EXAMPLE 2

A paper support laminated on the both sides thereof with polyethylene, was subjected to a corona discharge treatment, was provided with a gelatin subbing layer containing sodium dodecylbenzenesulfonate, and further was coated with the various photographic constitutional layers, whereby the multilayered color photographic paper 2A having the following layer constitution was prepared. The coating solutions were prepared in the following manner.

Preparation of the fifth layer coating solution

The cyan coupler (ExC-2) 63.9 g, the dye image stabilizer (Cpd-11) 29.1 g, the dye image stabilizer (Cpd-12) 29.1 g, the dye image stabilizer (Cpd-13) 1.9 g, the dye image stabilizer (Cpd-10) 1.9 g, the dye image stabilizer (Cpd-7) 67.8 g, and the UV absorber (UV-3) 34.9 g were dissolved in the solvent (Solv-6) 42.6 g, the solvent (Solv-7) 1.9 g, and ethyl acetate 180 ml, and this solution was emulsified and dispersed in a 10% gelatin aqueous solution 1000 g containing a 10% sodium dodecylbenzenesulfonate aqueous solution 60 ml and citric acid 10 g. Meanwhile, there was prepared the silver bromochloride emulsion (cube, the 1:4 mixture (silver mole ratio) of the large size emulsion with the average grain size of 0.50 μm and the small size emulsion with the average grain size of 0.41 μm, wherein the fluctuation coefficients in the grain size distributions were 0.09 and 0.11, respectively, and either size emulsions contained grains in which silver bromide 0.8 mol % was localized on a part of the grain surface and the rest was silver chloride). The same red-sensitive sensitizing dye as that used in Example 1 was added to this emulsion in the amounts of $0.9\times10^{-4}$ mole per mole of silver to the large size emulsion and $1.1\times10^{-4}$ mole per mole of silver to the small size emulsion. Then, this emulsion was subjected to a chemical sensitization by adding a sulfur sensitizer and a gold sensitizer. The foregoing emulsified dispersion and this silver bromochloride emulsion were mixed and dissolved, whereby the fifth layer coating solution was prepared so that it was of the following composition.

The coating solutions for the 1st layer to 4th layer, the 6th layer and the 7th layer were prepared in the same manner as that in the fifth layer coating solution. Sodium 1-oxy-3,5-dichloro-s-triazine was used as the hardener for the respective layers.

Further, the same preservative as that used in Example 1 was added to the respective layers in the same amount.

The silver bromochloride emulsions contained in the respective light-sensitive emulsion layers were subjected to a spectral sensitization with the same spectral sensitizing dyes and supersensitizers as those used for the blue-sensitive emulsion layer, green-sensitive emulsion layer and red-sensitive emulsion layer in Example 1 in the same amounts.

Further, 1-(5-methylureidophenyl)-5-mercaptotetrazole was added to the blue-sensitive emulsion layer, green-sensitive emulsion layer and red-sensitive emulsion layer in the amounts of $8.5\times10^{-5}$ mole, $7.7\times10^{-4}$ mole and $2.5\times10^{-4}$ mole per mole of silver halide, respectively.

Further, 4-hydroxy-6-methyl-1,3,3a,7-tetraazaindene was added to the blue-sensitive emulsion layer and green-sensitive emulsion layer in the amounts of $1\times10^{-4}$ mole and $2\times10^{-4}$ mole per mole of silver halide, respectively.

The following dyes (the values in the parentheses represent the coated amounts) were added to the emulsion layers in order to prevent an irradiation.

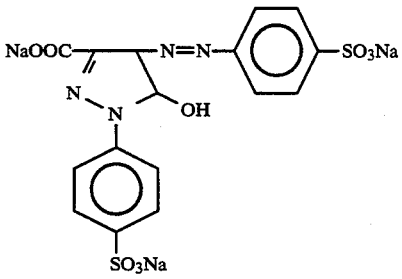

(10 mg/m²)

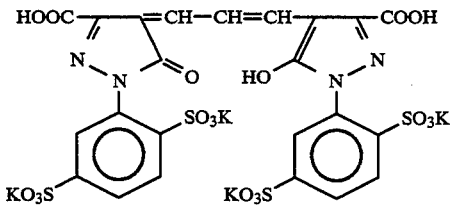

(10 mg/m²)

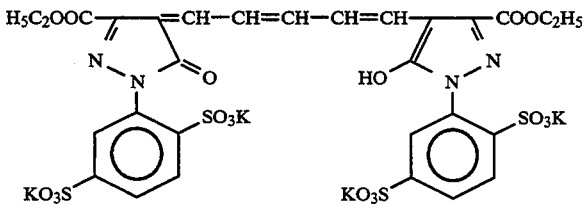

(40 mg/m²)

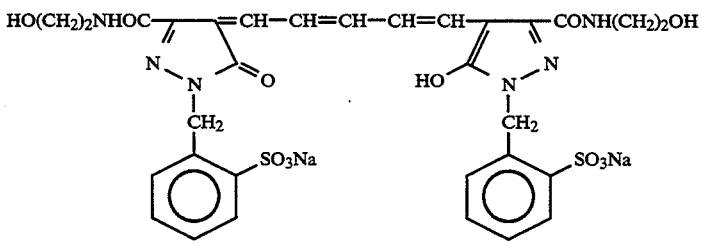

(20 mg/m²)

The compositions of the respective layers are shown below. The numerals represent the coated amounts (g/m²). The coated amounts of the silver halide emulsions are expressed in terms of the amounts converted to silver.

| | |
|---|---|
| Support: | |
| Polyethylene laminated paper [polyethylene coated on the 1st layer side contains a white pigment ($TiO_2$) and a blue dye (ultramarine)]. | |
| First layer (a blue-sensitive emulsion layer): | |
| Silver bromochloride emulsion (the same emulsion as that contained in the blue-sensitive emulsion layer in Example 1) | 0.27 |
| Gelatin | 1.36 |
| Yellow coupler (ExY) | 0.79 |
| Dye image stabilizer (Cpd-7) | 0.08 |
| Dye image stabilizer (Cpd-9) | 0.04 |
| Solvent (Solv-1) | 0.18 |
| Solvent (Solv-7) | 0.18 |

-continued

| | |
|---|---|
| Second layer (an anti-color mixing layer): | |
| Gelatin | 1.00 |
| Anti-color mixing agent (Cpd-5) | 0.06 |
| Solvent (Solv-10) | 0.03 |
| Solvent (Solv-1) | 0.25 |
| Solvent (Solv-4) | 0.25 |
| Third layer (a green-sensitive emulsion layer): | |
| Silver bromochloride emulsion (the same emulsion as that contained in the green-sensitive emulsion layer in Example 1) | 0.13 |
| Gelatin | 1.45 |
| Magenta coupler (ExM-2) | 0.16 |
| Dye image stabilizer (Cpd-3) | 0.15 |
| Dye image stabilizer (Cpd-9) | 0.03 |
| Dye image stabilizer (Cpd-10) | 0.01 |
| Dye image stabilizer (Cpd-4) | 0.01 |
| Dye image stabilizer (Cpd-2) | 0.08 |
| Solvent (Solv-4) | 0.50 |
| Solvent (Solv-8) | 0.15 |
| Solvent (Solv-9) | 0.15 |
| Fourth layer (an anti-color mixing layer): | |
| Gelatin | 0.70 |
| Anti-color mixing agent (Cpd-5) | 0.04 |
| Solvent (Solv-10) | 0.02 |
| Solvent (Solv-1) | 0.18 |
| Solvent (Solv-4) | 0.18 |
| Fifth layer (a red-sensitive emulsion layer): | |
| Silver bromochloride emulsion described above | 0.18 |
| Gelatin | 0.80 |

-continued

| | |
|---|---|
| Cyan coupler (ExC-2) | 0.33 |
| UV absorber (UV-3) | 0.18 |
| Dye image stabilizer (Cpd-11) | 0.01 |
| Dye image stabilizer (Cpd-12) | 0.01 |
| Dye image stabilizer (Cpd-13) | 0.01 |
| Solvent (Solv-6) | 0.22 |
| Dye image stabilizer (Cpd-10) | 0.01 |
| Dye image stabilizer (Cpd-7) | 0.35 |
| Solvent (Solv-7) | 0.01 |
| Sixth layer (a UV absorbing layer): | |
| Gelatin | 0.55 |
| UV absorber (UV-2) | 0.38 |
| Dye image stabilizer (Cpd-14) | 0.15 |
| Dye image stabilizer (Cpd-3) | 0.02 |
| Seventh layer (a protective layer): | |
| Gelatin | 1.13 |
| Acryl-modified copolymer of polyvinyl alcohol (a modification degree: 17%) | 0.05 |
| Liquid paraffin | 0.02 |
| Dye image stabilizer (Cpd-15) | 0.01 |

(ExM-2) Magenta coupler

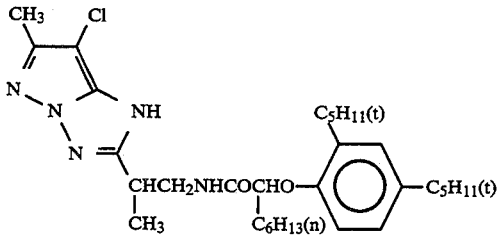

(ExC-2) Cyan coupler
3:7 mixture (mole ratio) of

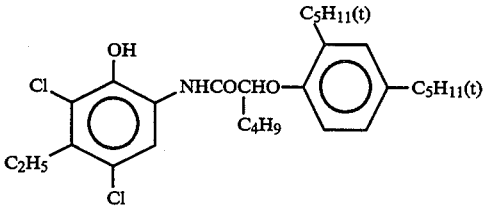

and

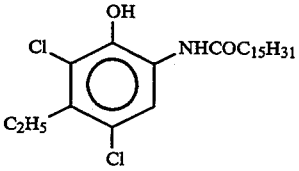

(Cpd-10) Dye image stabilizer

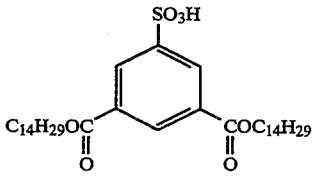

(Cpd-11) Dye image stabilizer

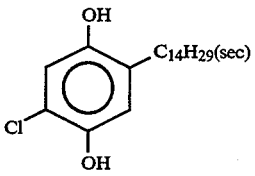

(Cpd-12) Dye image stabilizer

-continued

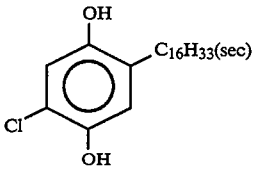

(Cpd-13) Dye image stabilizer

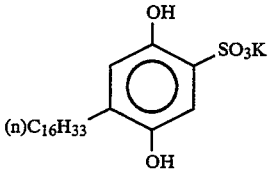

(Cpd-14) Dye image stabilizer

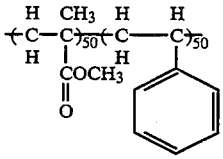

Average molecular weigth: about 60,000

(Cpd-15) Dye image stabilizer

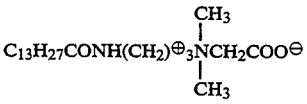

(UV-2) UV absorber
1:5:10:5 mixture (weight ratio) of

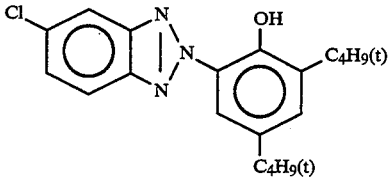

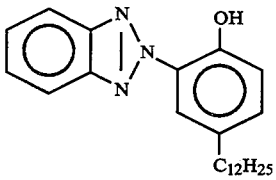

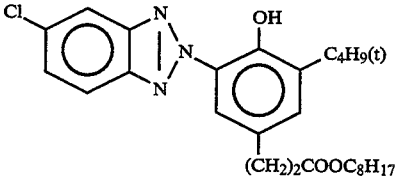

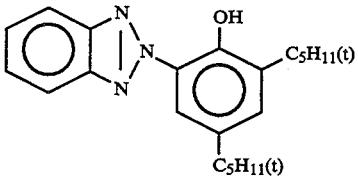

(UV-3) UV absorber

-continued

1:2:2 mixture (weight ratio) of

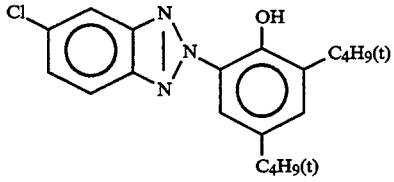

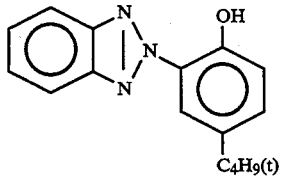

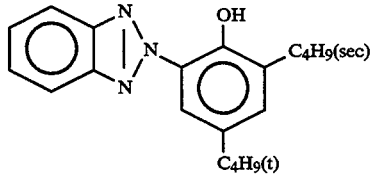

(Solv-7) Solvent

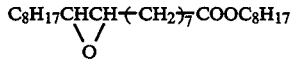

(Solv-8) Solvent

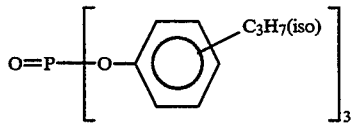

(Solv-9) Solvent

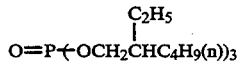

(Solv-10) Solvent

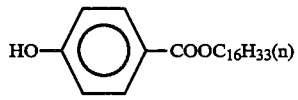

Further, the comparative color photographic papers 201 to 206 having the similar compositions to that of Sample 2A were prepared as shown in Table 3 in the same manner as that in Sample 2A except that the epoxy compounds or comparative compounds were added to the solvents used in the first layer (the blue-sensitive emulsion layer), second layer, fourth layer or fifth layer in the prescribed amounts, or the cyan coupler (ExC) used in the fifth layer (the red-sensitive emulsion layer) was replaced with the cyan couplers of the present invention in the prescribed amounts.

Further, the color photographic papers 207 to 226 of the invention having the similar compositions to that of Sample 2A were prepared as shown in Table 3 in the same manner as that in Sample 2A except that the various epoxy compounds of the present invention were added to the solvents used in the first layer (the blue-sensitive emulsion layer), second layer, fourth layer or fifth layer in the prescribed amounts and that the cyan coupler (ExC) used in the fifth layer (the red-sensitive emulsion layer) was replaced with the various cyan couplers of the present invention in the same moles and the coated amount of the fifth layer was reduced so that the coated amount of the coupler became as shown in Table 3.

TABLE 3

| | | Epoxy compound | | | Cyan coupler | |
|---|---|---|---|---|---|---|
| Color graphic | Photo-paper | Compound No. | Coated amount (g/m²) | Added layer | Compound No. | Coated amount (g/m²) |
| 201 | (Comp.) | A-26 | 0.08 | 4th | ExC | 0.33 |
| 202 | " | A-47 | 0.08 | 5th | ExC | 0.33 |
| 203 | " | A-47 | 0.16 | 5th | Exc | 0.33 |
| 204 | " | Comparative Compound Cpd-16 | 0.08 | 2nd | C-11 | 0.33 |
| 205 | " | Comparative Compound Cpd-20 | 0.08 | 5th | C-10 | 0.20 |
| 206 | " | Comparative Compound Cpd-20 | 0.16 | 5th | C-35 | 0.20 |
| 207 | (Inv.) | A-18 | 0.08 | 1st | C-10 | 0.20 |
| 208 | " | A-18 | 0.08 | 5th | C-10 | 0.33 |
| 209 | " | A-26 | 0.08 | 2nd | C-10 | 0.20 |
| 210 | " | A-34 | 0.04 | 5th | C-19 | 0.20 |
| 211 | " | A-34 | 0.08 | 5th | C-19 | 0.20 |
| 212 | " | A-34 | 0.16 | 4th | C-19 | 0.20 |
| 213 | " | A-35 | 0.04 | 5th | C-11 | 0.15 |
| 214 | " | A-35 | 0.04 | 4th | C-11 | 0.20 |
| 215 | " | A-35 | 0.08 | 5th | C-11 | 0.15 |
| 216 | " | A-35 | 0.08 | 4th | C-11 | 0.20 |
| 217 | " | A-35 | 0.08 | 2nd | C-11 | 0.33 |
| 218 | " | A-35 | 0.16 | 5th | C-11 | 0.20 |
| 219 | " | A-35 | 0.16 | 5th | C-2 | 0.20 |
| 220 | " | A-35 | 0.16 | 5th | C-4 | 0.20 |
| 221 | " | A-35 | 0.16 | 5th | C-12 | 0.20 |
| 222 | " | A-37 | 0.08 | 4th | C-13 | 0.20 |
| 223 | " | A-47 | 0.08 | 5th | C-17 | 0.20 |
| 224 | " | A-48 | 0.08 | 5th | C-39 | 0.20 |
| 225 | " | A-48 | 0.08 | 2nd | C-21 | 0.20 |
| 226 | " | A-48 | 0.08 | 1st | C-21 | 0.20 |

These samples were subjected to the exposure and processing in the same manners as those in Example 1 and the color image storing performance was evaluated in the same manner as that in Example 1. The results thereof are shown in Table 4.

TABLE 4

| | Dark fading at 80° C. & 70% RH for 5 days | | | | | | Light fading with Xe for 5 days | | |
|---|---|---|---|---|---|---|---|---|---|
| | Replenishing solution a | | Replenishing solution b | | Replenishing solution c | | Replenishing solution a | Replenishing solution b | Replenishing solution c |
| | Replenishing amount*** | | | | | | Replenishing amount*** | | |
| | 160 ml | | 90 ml | | 70 ml | | 160 ml | 90 ml | 70 ml |
| Sample No. | D = 0.5* | D = 1.5** | D = 0.5* | D = 1.5** | D = 0.5* | D = 1.5** | D = 1.5** | D = 1.5** | D = 1.5** |
| 201 (Comp.) | 34 | 35 | 39 | 41 | 40 | 43 | 15 | 19 | 19 |
| 202 (Comp.) | 36 | 38 | 41 | 44 | 42 | 45 | 14 | 18 | 18 |
| 203 (Comp.) | 35 | 35 | 41 | 42 | 41 | 43 | 13 | 18 | 19 |

TABLE 4-continued

| | Dark fading at 80° C. & 70% RH for 5 days | | | | | | Light fading with Xe for 5 days | | |
|---|---|---|---|---|---|---|---|---|---|
| | Replenishing solution a | | Replenishing solution b | | Replenishing solution c | | Replenishing solution a | Replenishing solution b | Replenishing solution c |
| | Replenishing amount*** | | | | | | Replenishing amount*** | | |
| | 160 ml | | 90 ml | | 70 ml | | 160 ml | 90 ml | 70 ml |
| Sample No. | D = 0.5* | D = 1.5** | D = 0.5* | D = 1.5** | D = 0.5* | D = 1.5** | D = 1.5** | D = 1.5** | D = 1.5** |
| 204 (Comp.) | 30 | 21 | 38 | 26 | 38 | 27 | 17 | 21 | 23 |
| 205 (Comp.) | 27 | 20 | 34 | 26 | 36 | 26 | 15 | 19 | 20 |
| 206 (Comp.) | 26 | 18 | 35 | 24 | 37 | 27 | 16 | 19 | 19 |
| 207 (Inv.) | 25 | 19 | 26 | 20 | 26 | 21 | 16 | 17 | 17 |
| 208 (Inv.) | 24 | 17 | 24 | 18 | 24 | 18 | 12 | 13 | 14 |
| 209 (Inv.) | 25 | 19 | 26 | 19 | 26 | 19 | 16 | 16 | 16 |
| 210 (Inv.) | 26 | 20 | 26 | 21 | 26 | 22 | 13 | 13 | 13 |
| 211 (Inv.) | 23 | 19 | 23 | 20 | 24 | 20 | 12 | 12 | 13 |
| 212 (Inv.) | 22 | 19 | 22 | 19 | 22 | 19 | 13 | 14 | 14 |
| 213 (Inv.) | 23 | 18 | 23 | 18 | 23 | 19 | 14 | 15 | 15 |
| 214 (Inv.) | 24 | 20 | 25 | 21 | 26 | 21 | 15 | 16 | 17 |
| 215 (Inv.) | 21 | 17 | 22 | 18 | 22 | 18 | 12 | 13 | 13 |
| 216 (Inv.) | 22 | 18 | 23 | 20 | 23 | 21 | 12 | 13 | 14 |
| 217 (Inv.) | 24 | 21 | 24 | 22 | 24 | 23 | 14 | 16 | 16 |
| 218 (Inv.) | 20 | 15 | 21 | 17 | 21 | 18 | 12 | 12 | 12 |
| 219 (Inv.) | 23 | 18 | 23 | 18 | 23 | 19 | 11 | 12 | 12 |
| 220 (Inv.) | 21 | 17 | 21 | 18 | 21 | 19 | 12 | 12 | 13 |
| 221 (Inv.) | 22 | 18 | 24 | 20 | 24 | 20 | 12 | 13 | 14 |
| 222 (Inv.) | 24 | 20 | 25 | 21 | 25 | 22 | 13 | 14 | 14 |
| 223 (Inv.) | 23 | 18 | 23 | 19 | 23 | 20 | 13 | 14 | 14 |
| 224 (Inv.) | 22 | 18 | 22 | 18 | 25 | 19 | 12 | 13 | 13 |
| 225 (Inv.) | 23 | 20 | 24 | 20 | 25 | 21 | 14 | 16 | 16 |
| 226 (Inv.) | 25 | 21 | 27 | 23 | 28 | 23 | 15 | 15 | 16 |

*fading rate (%) at the initial density of 0.5.
**fading rate (%) at the initial density of 1.5.
***per $m^2$ of the light-sensitive material.

As apparent from the results summarized in Table 15, in the color photographic papers 207 to 226 of the invention, the storing performances of the cyan dye images are excellent compared with those of the comparative samples 201 to 206 and these excellent performances are maintained without depending on the replenishing amounts of the processing solutions.

EXAMPLE 3

There was prepared a comparative sample having the same constitution as that of the light-sensitive material shown by Sample 601 in Example 6 described in JP-A-2-139544. Then, the cyan couplers C-1, C-2 and C-3 contained in the fourth layer, fifth layer and sixth layer of this sample were replaced with the couplers of the present invention shown in Example 1 and similarly to Example 1, the epoxy compounds of the present invention were added to the fourth to sixth layers, whereby the samples of the invention were prepared. They were evaluated in the same manner as that in Example 1. Also in this case, the samples of the invention provided the almost same results as those obtained in Example 1.

While the invention has been described in detail and with reference to specific embodiments thereof, it will be apparent to one skilled in the art that various changes and modifications can be made therein without departing from the spirits and scope thereof.

What is claimed is:

1. A method of forming a color image, comprising:

subjecting a silver halide color photographic light-sensitive material comprising a support, having provided thereon a light-sensitive silver halide emulsion layer containing a yellow dye-forming coupler, a light-sensitive silver halide emulsion layer containing a magenta dye-forming coupler, a light-sensitive silver halide emulsion layer containing a cyan dye-forming coupler, and a non-light-sensitive hydrophilic colloid layer, to an exposure and then to a color development with a color developing solution;

wherein each of said silver halide emulsion layers comprises a substantially iodide-free silver chloride or chlorobromide emulsion having a chloride content of at lease 90 mole %, said light-sensitive silver halide emulsion layer that contains a cyan dye-forming coupler comprising at least one sparingly water soluble epoxy compound in an amount in the range of 3 to 100% by weight based on the amount of the cyan dye-forming coupler and which has at least one group represented by the following Formula (AO) and at least one pyrroloazole type cyan coupler represented by the following Formula (Ia) in an amount in the range of $1\times10^{-3}$ to 1 mole per mole of silver halide; and wherein the light-sensitive material is processed so that a replenishing amount of the color developing solution utilized is between 30 ml and 100 ml per $m^2$ of the light-sensitive material;

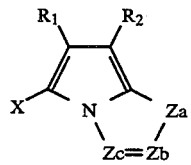

Formula (Ia)

wherein Za represents —NH— or —CH($R_3$)—, and Zb and Zc each represent —C($R_4$)= or —N=; $R_1$, $R_2$ and $R_3$ each represent an electron attractive group having a Hammett's substituent constant $\sigma_p$ of 0.20 or more, provided that the sum of the $\sigma_p$ values of $R_1$ and $R_2$ is 0.65 or more; $R_4$ represents a hydrogen atom or a substituent, provided that when two $R_4$'s are present in the formula, they may be the same or different; X represents a hydrogen atom or a group capable of splitting off upon a reaction with an oxidation product of an aromatic primary amine color developing agent; the group represented by $R_1$, $R_2$, $R_3$, $R_4$ or X may become a divalent group and combine to form a dimer or higher polymer, or bond to a high molecular chain to form a homopolymer or a copolymer;

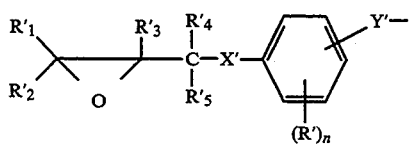

Formula (AO)

wherein $R'_1$, $R'_2$, $R'_3$, $R'_4$ and $R'_5$ may be the same or different and each represent a hydrogem atom, an alkyl group or an aryl group; R' represents a substituent and n represents an integer of 0 to 4; —Y'— represents a divalent linkage group; —X'— represents —O—, —S— or —N(R'')—; R'' represents a hydrogen atom, an acyl group, an alkylsulfonyl group, an arylsulfonyl group, an aryl group, a heterocyclic group, or $—C(R'_6)(R'_7)(R'_8)$, in which $R'_6$, $R'_7$ and $R'_8$ may be the same or different and each represents an alkyl group or a group represented by the following Formula (AO-1); and alternatively $R'_6$ and $R'_7$ can each represent a hydrogen atom;

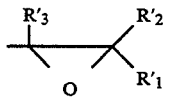

Formula (AO-1)

when n is 2, 3 or 4, plural R's may be the same as or different from each other; any two of $R'_1$ to $R'_5$, R'' and R' or two R's may combine with each other to form a 5- to 7-membered ring.

2. The method of forming a color image as recited in claim 1, where in Formula (Ia):

$R_1$, $R_2$, $R_3$ are selected from the group consisting of an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with an electron attractive group having an $\sigma_p$ value of 0.20 or more, a heterocyclic group, a halogen atom, an azo group, and a selenocyanate group;

$R_4$ is a hydrogen atom or a substituent selected from the group consisting of:

a halogen atom, an optionally substituted aliphatic group, an optionally substituted aryl group, an optionally substituted heterocyclic group, an alkoxy group, an aryloxy group, a heterocyclic oxy group, an alkylthio group, an arylthio group, a heterocyclic thio group, an acyloxy group, a carbamoyloxy group, a silyloxy group, a sulfonyloxy group, an acyloamino group, an alkylamino group, an arylamino group, a ureido group, a sulfamoylamino group, an alkenyloxy group, a formyl group, an alkyl acyl group, an aryl acyl group, a heterocyclic acyl group, an alkyl sulfonyl group, an aryl sulfonyl group, a heterocyclic sulfonyl group, an alkyl sulfinyl group, an aryl sulfinyl group, a heterocyclic sulfinyl group, an alkyl oxy carbonyl group, an aryl oxy carbonyl group, a heterocyclic oxy carbonyl group, an alkyl oxy carbonylamino group, an aryl oxy carbonylamino group, a heterocyclic oxy carbonylamino group, a sulfonamide group, a carbamoyl group, a sulfamoyl group, a phosphonyl group, a sulfamide group, an imide group, an azolyl group, a hydroxy group, a cyano group, a carboxy group, a nitro group, a sulfo group, and an unsubstituted amino group;

X is a hydrogen atom or a splitting off group selected from the group consisting of:

a halogen atom, an aromatic azo group, an alkyl group, an aryl group, a heterocyclic group, an alkyl sulfonyl group, an arylsulfonyl group, an arylsulfinyl group, an alkoxy carbonyl group, an aryloxy carbonyl group, a heterocyclic oxy carbonyl group, an aminocarbonyl group; an alkyl carbonyl group, an aryl carbonyl group and a heterocyclic carbonyl group, each bonded to a coupling site via an oxygen, nitrogen, sulfur or carbon atom; and a heterocyclic group bonded to the coupling site via a nitrogen atom in the heterocycle.

3. The method of forming a color image as recited in claim 1, wherein the compound of Formula (AO) has a solubility in water of 10% or less at 25° C. and the sum of the number of carbon atoms therein is 9 or more.

4. The method of forming a color image as recited in claim 2, wherein the compound of Formula (AO) has a solubility in water of 10% or less at 25° C. and the sum of the number of carbon atoms therein is 9 or more.

5. The method of forming a color image as recited in claim 3, wherein:

the R' substituent in Formula (AO) is selected from the group consisting of:

an alkyl group, an alkenyl group, an alkynyl group, an aryl group, a heterocyclic group, an alkoxy group, an aryloxy group, an alkylthio group, an arylthio group, a hydroxy group, a halogen atom, a cyano group, a nitro group, an acyl group, an acyloxy group, a silyloxy group, a sulfonyl group, a sulfonyloxy group, an alkoxycarbonyl group, an aryloxycarbonyl group, an amide group, an imide group, a carbamoyl group, a sulfamoyl group, a ureido group, a urethane group, an aminosulfamoyl group, an amino group, an alkylamino group, an arylamino group, and a heterocyclic amino group; and Y' is selected from the group consisting of:

—O—, —S—, $—SO_2—$, $—O—CO_2—$, an optionally substituted imino group, an optionally substituted alkylene group, an optionally substituted phenylene group, a naphthalene group, and a divalent heterocyclic group.

6. The method of forming a color image as recited in claim 4, wherein:

the R' substituent in Formula (AO) is selected from the group consisting of:

an alkyl group, an alkenyl group, an alkynyl group, an aryl group, a heterocyclic group, an alkoxy group, an aryloxy group, an alkylthio group, an arylthio group, a hydroxy group, a halogen atom, a cyano group, a nitro group, an acyl group, an acyloxy group, a silyloxy group, a sulfonyl group, a sulfonyloxy group, an alkoxycarbonyl group, an aryloxycarbonyl group, an amide group, an imide group, a carbamoyl group, a sulfamoyl group, a ureido group, a urethane group, an aminosulfamoyl group, an amino group, an alkylamino group, an arylamino group, and a heterocyclic amino group; and Y' is selected from the group consisting of:

—O—, —S—, —$SO_2$—, —O—$CO_2$—, an optionally substituted imino group, an optionally substituted alkylene group, an optionally substituted phenylene group, a naphthalene group, and a divalent heterocyclic group.

7. The method as claimed in claim 1, wherein said silver halide emulsion layer containing a cyan dye-forming coupler is a red-sensitive emulsion layer.

8. The method as claimed in claim 1, wherein the cyan dye-forming coupler is a pyrroloazole compound selected from those represented by the following general formula (IIa), (IIIa) or (IVa):

(IIa)

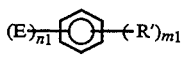

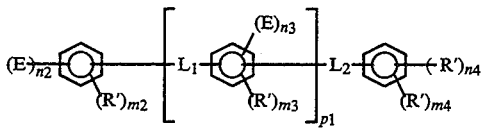

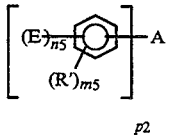

(IIIa)

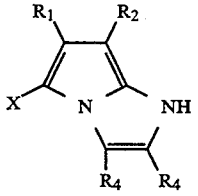

(IVa)

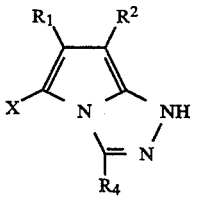

wherein $R_1$, $R_2$, $R_4$ and X have the same meanings as in general formula (Ia), respectively.

9. The method of claim 8, wherein the cyan dye-forming coupler is a pyrroloazole compound selected from those represented by general formula (IIIa).

10. The method of claim 1, wherein the electron-withdrawing group represented by $R_1$, $R_2$, and $R_3$ each has the $\sigma_p$ value of at least 0.35.

11. The method of claim 1, wherein the electron-withdrawing groups represented by $R_1$, $R_2$, and $R_3$ are those having a $\sigma_p$ value ranging from 0.20 to 1.0.

12. The method as claimed in claim 1, wherein $R_1$ is a cyano a trifluoromethyl group, a straight or branched unsubstituted alkoxycarbonyl group, an alkoxycarbonyl group substituted with a carbamoyl grop, an ether linkage-containing alkoxycarbonyl group, an unsubstituted aryloxycarbonyl group or an alkyl- or alkoxy-substituted aryloxycarbonyl group.

13. The method of forming a color image as recited in claim 1, wherein said sparingly water soluble epoxy compound is represented by the following formula (AE-1), (AE-2), (AE-3), or (AE-4):

Formula (AE-1)

Formula (AE-2)

Formula (AE-3)

(AE-4)

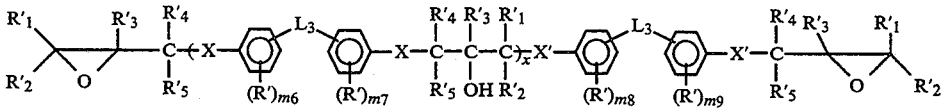

wherein E, and if more than one each independently, represents:

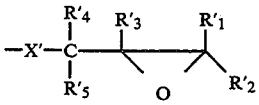

wherein $L_1$, $L_2$, and $L_3$ may be the same or different and each represents a divalent linkage group; $n_1$ represents an integer from 3 to 6; $m_1$ represents an integer from 0 to 3; $n_2$ represents an integer from 1 to 5; $n_3$ represents an integer from 1 to 4; $n_4$ represents an integer from 1 to 5; $m_2$ represents an integer from 0 to 4; $m_3$ represents an integer from 0 to 3; $m_4$ represents an integer from 0 to 4; $n_5$ represents an integer from 1 to 5; $m_5$ represents an integer from 0 to 4; $m_6$ to $m_9$ represent an integer from 0 to 4; $p_1$ and x represent a real number from 0 to 20; $p_2$ represents an integer from 3 to 4; and A represents a tri- or tetravalent organic group.

14. The method of forming a color image as recited in claim 13, wherein said sparingly water soluble epoxy compound is represented by formula (AE-2).

* * * * *